US005783042A

United States Patent [19]

Leeman et al.

[11] Patent Number: 5,783,042

[45] Date of Patent: Jul. 21, 1998

[54] SYSTEM AND METHOD OF MEASURING DEFLECTED DOCTOR BLADE ANGLE AND LOADING FORCE

[75] Inventors: David A. Leeman, Worcester; Steven J. Coleman, Marlborough; David J. Dziadzio, Belchertown, all of Mass.; William K. Giguere, North Smithfield, R.I.; Ronald F. Goodnow, Leicester, Mass.

[73] Assignee: Thermo Web Systems, Inc., Auburn, Mass.

[21] Appl. No.: 567,938

[22] Filed: Dec. 6, 1995

[51] Int. Cl.[6] ..... D21F 11/00

[52] U.S. Cl. ..... 162/198; 15/256.51; 162/111; 162/199; 162/262; 162/263; 162/281; 162/DIG. 10; 264/283

[58] Field of Search ..... 162/111, 198, 162/199, 262, 263, 281, DIG. 10, 272; 264/283; 15/256.51

[56] References Cited

U.S. PATENT DOCUMENTS

| | | |
|---|---|---|
| 3,065,486 | 11/1962 | Scott . |
| 3,065,487 | 11/1962 | Scott . |
| 3,163,575 | 12/1964 | Nobbe . |
| 3,778,861 | 12/1973 | Goodnow . |
| 3,783,781 | 1/1974 | Grommek . |
| 4,092,916 | 6/1978 | Link et al. . |
| 4,111,746 | 9/1978 | Biondetti . |
| 4,192,709 | 3/1980 | Dunlap . |
| 4,309,960 | 1/1982 | Waldvogel . |
| 4,789,432 | 12/1988 | Goodnow et al. . |
| 4,850,474 | 7/1989 | Schwarze . |
| 4,906,335 | 3/1990 | Goodnow et al. . |
| 4,919,756 | 4/1990 | Sawdai . |
| 5,021,124 | 6/1991 | Turtinen et al. . |
| 5,269,846 | 12/1993 | Eskelinen et al. . |
| 5,279,710 | 1/1994 | Aikawa . |
| 5,321,483 | 6/1994 | Yokoyama et al. . |

FOREIGN PATENT DOCUMENTS

| | | |
|---|---|---|
| 23 27 383 | 1/1975 | Germany . |
| WO 93/05229 | 3/1993 | WIPO . |

OTHER PUBLICATIONS

Tissue World 95, The 2nd Internatiional Conference and Exhibition for the Tissue Business, 14–16 Mar. 1995, France, Session 2: Papermaking, "Creping doctor with adjustable angle—A new design".

*Primary Examiner*—Peter Chin

*Attorney, Agent, or Firm*—Samuels, Gauthier, Stevens & Reppert

[57] ABSTRACT

A method and system of measuring deflected doctor blade angle and loading force of an arrangement including a doctor apparatus operating in connection with a rotating cylinder, the apparatus having a doctor blade and a support member which pivots about at least one pivot point in response to an externally applied force for applying the doctor blade to a contact point on the cylinder. The arrangement corresponds to a kinematic model of linkages including a first link defined between the at least one pivot point and the contact point, a second link defined between the contact point and the center of the cylinder, and a third link defined between the center of the cylinder and the at least one pivot point. The method includes measuring the angle between a selected pair of the links; determining the remaining angles between the links as a function of the measured angle; determining an undeflected blade angle which corresponds to an angle between the doctor blade and a tangent line through the contact point on the cylinder, the undeflected blade angle being a function of the determined angle between the first and second links; measuring the externally applied force; ascertaining the blade load as a function of moment balances of the measured angle and the measured externally applied force; and ascertaining the deflected blade angle as a function of the undeflected blade angle and the blade load.

3 Claims, 19 Drawing Sheets

SYSTEM AND METHOD OF MEASURING DEFLECTED DOCTOR BLADE ANGLE AND LOADING FORCE

BACKGROUND OF THE INVENTION

The present invention relates to a system and method of on-line real-time measuring of deflected doctor blade angle and loading force of a doctor apparatus.

Commercial papermaking machines typically include a series of cylindrical rotating surfaces that form, squeeze, dry and wind-up paper on a continuous basis. To maintain production these rotating cylinders are continuously cleaned of papermaking debris. Failure to maintain process cleanliness leads to process interruption, and machine downtime. All paper machines use devices referred to as "doctors" to clean these cylinders. Doctors are operable for pressing doctor blades, thin pieces of metal or composite material of rectangular aspect, against the rotating cylinders to scrape off paper fibers and other debris. Doctors also serve to prevent the paper web from wrapping around the cylinders in the event of a web break. Except for a few special cases, doctors never purposely contact the paper during normal production.

Machines producing tissue papers, for example bathroom facial toweling, are one of those exceptions. These machines use a single enormous drying cylinder, know as a Yankee, and require a specialized doctor called a creping doctor. Creping doctors are designed for continuous contact with the yankee cylinder and the paper web. The operation of a creping doctor is to scrape the tissue paper off the large (12–18 ft diameter) drying cylinder, a process referred to as creping.

With reference to FIG. 1, a conventional doctoring apparatus 10 is shown. The apparatus includes a doctor back 2 having a journal 4 with a generally L-shaped configuration with end shafts supported in bearings 6 for rotation about an axis Al. The bearings are carried on a support structure 8. The doctor back is rotated about axis $A_1$ by any conventional means, for example pneumatically actuated piston-cylinder units 14. The doctor back carries a blade holder 16 which receives a doctor blade 18. Blade loading pressure is a function of the force being exerted by the units 14, and the blade angle is a function of the rotational position of the doctor back with respect to the surface S of a roll or cylinder 19 and blade loading.

There are two performance measurements of importance for doctors of all types: blade angle and blade loading. Blade angle is that angle formed between the cylinder-facing blade surface and the cylinder tangent at the contact point. Blade load is the force exerted by the blade on the cylinder per unit contact length. This force measurement is usually provided in pounds-per-lineal-inch or PLI.

With reference now to FIG. 2, the operative relationship between the doctor blade 18 and the associated cylinder 19 is shown. It will be appreciated that the thickness of the blade relative to the cylinder is exaggerated to facilitate the illustration of the necessary angular relationships. Accordingly, line 20 is tangent to cylinder 19; line 21 is a radius-line of cylinder 19 which extends through the point of contact P of the doctor blade 18; and arrow 22 indicates the direction of rotation of the cylinder. Therefore, angle A is the set blade angle and angle B is the impact angle.

Long experience has established optimum blade angle and load ranges for various cylinders on the paper machine. Generally, cleaning doctors run blade angles of 25°–30° and loads of 0.75–3.5 PLI. Blade angles much below these minimums preclude good cylinder cleaning, leading to contaminated, lower quality product, and often to sheet-breaks or other process interruptions. Lower blade loads may also prevent the doctor from shedding the sheet, the other primary operation of the doctor. Higher blade loads simply increase the blade abrasion rate and shorten its life.

Creping doctors typically run 10°–30° blade angles, called the creping angle, and 15–40 PLI blade loads. Directly related to the creping angle is the impact angle, which controls two important paper properties considered desirable for tissue papers: "softness" and "bulk". The impact angle is that angle formed between the blade surface contacting the paper and the tangent to the cylinder at the blade contact point.

The doctor blade is a flexible member, which deflects and bends with increasing blade load. The deflecting and bending alters the blade angle and, for creping doctors, the impact angle. The low blade loadings imposed on typical cleaning doctors create such small deflections and bending induced curvature that the resulting blade angle change has a negligible effect on the doctor's cleaning and sheet-shedding performance. Creping doctors, with their high blade loads, deflect and bend the blade substantially, altering tissue properties and quality. For creping doctors, as with cleaning doctors, blade loading also strongly influences sheet shedding. For tissue making, poor sheet shedding interferes with the process and often interrupts production until adequate sheet shedding is restored. Lost production is expensive and papermakers are understandably reluctant to alter blade loading once they find a setting that sheds and crepes the sheet well.

The current difficulty for papermakers is that they do not reliably know either the deflected blade angle or blade load while the paper machine is running. The conventional systems can only measure blade angle under static, non-rotating conditions using gauges placed on the blade and the stationary cylinder surface. The systems cannot determine blade angle on-line under dynamic conditions.

It is therefore an object of the present invention to provide a system and method which gives the papermaker on-line deflected blade angle and load measurements under dynamic conditions. This capability leads directly to on-line control of these operational parameters.

SUMMARY OF THE INVENTION

The present invention provides a method and system of measuring and controlling deflected doctor blade angle and loading force of an arrangement including a doctor apparatus operating in connection with a rotating cylinder, the apparatus having a doctor blade and a support member which pivots about at least one pivot point in response to an externally applied force for applying the doctor blade to a contact point on the cylinder. The arrangement corresponds to a kinematic set of linkages including a first link defined between at least one pivot point and the contact point, a second link defined between the contact point and the center of the cylinder, and a third link defined between the center of the cylinder and the at least one pivot point. The method and system include steps and means for measuring the angle between a selected pair of the links; determining the remaining angles between the links as a function of the measured angle; determining an undeflected blade angle which corresponds to an angle between the doctor blade and a tangent line through the contact point on the cylinder, the undeflected blade angle being a function of the determined angle between the first and second links; measuring the externally applied force; ascertaining the blade load as a function of moment balances of the measured angle and the measured externally applied force; and ascertaining the deflected blade angle as a function of the undeflected blade angle and the blade load. The blade angle and blade load measurements are then available for monitoring and/or controlling purposes.

DETAILED DESCRIPTION OF THE ILLUSTRATED EMBODIMENTS

Figure 1:
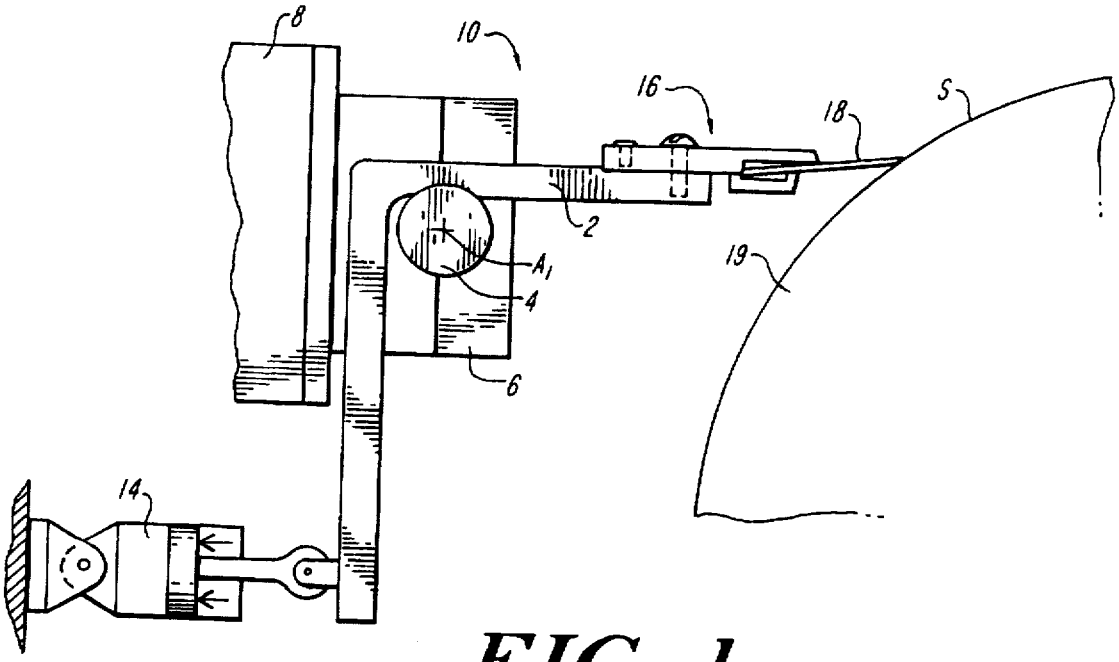
FIG. 1 (PRIOR ART)
FIG. 1 shows a conventional doctoring apparatus.
Figure 2:
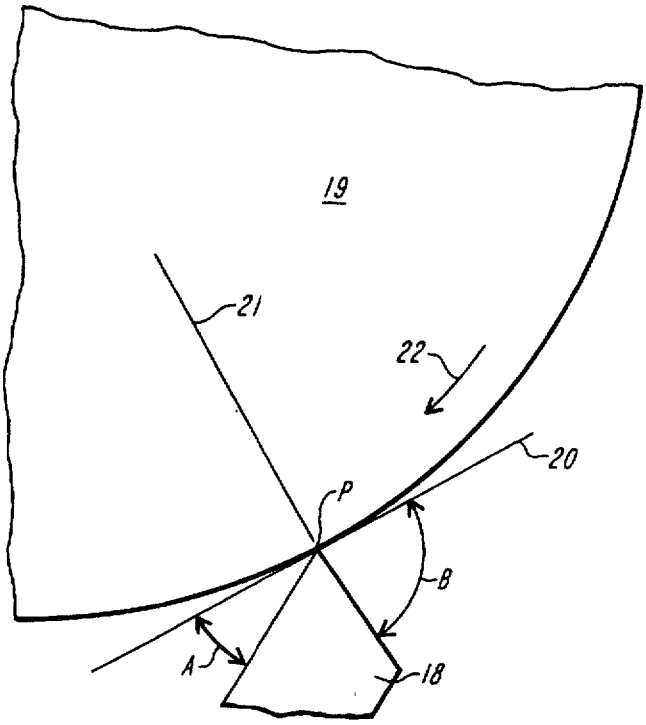
FIG. 2 (PRIOR ART)
FIG. 2 shows an exploded view of the operative relationship between a doctor blade and an associated cylinder in a conventional doctoring apparatus.
Figure 3:
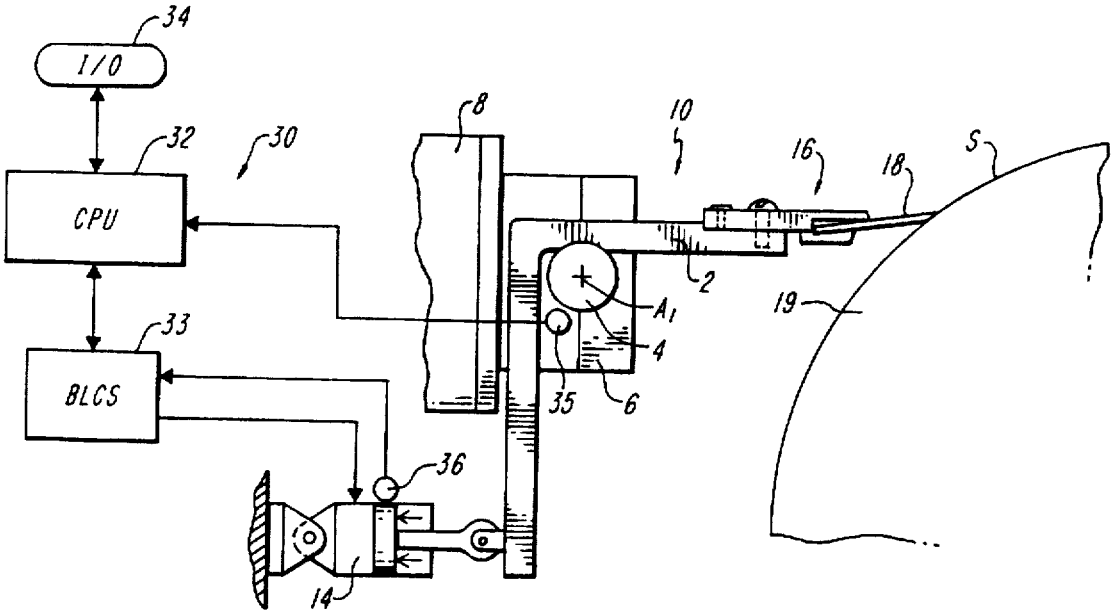
FIG. 3 shows an exemplary system for measuring the deflected blade angle and the loading force in accordance with the present invention.
Figure 4:
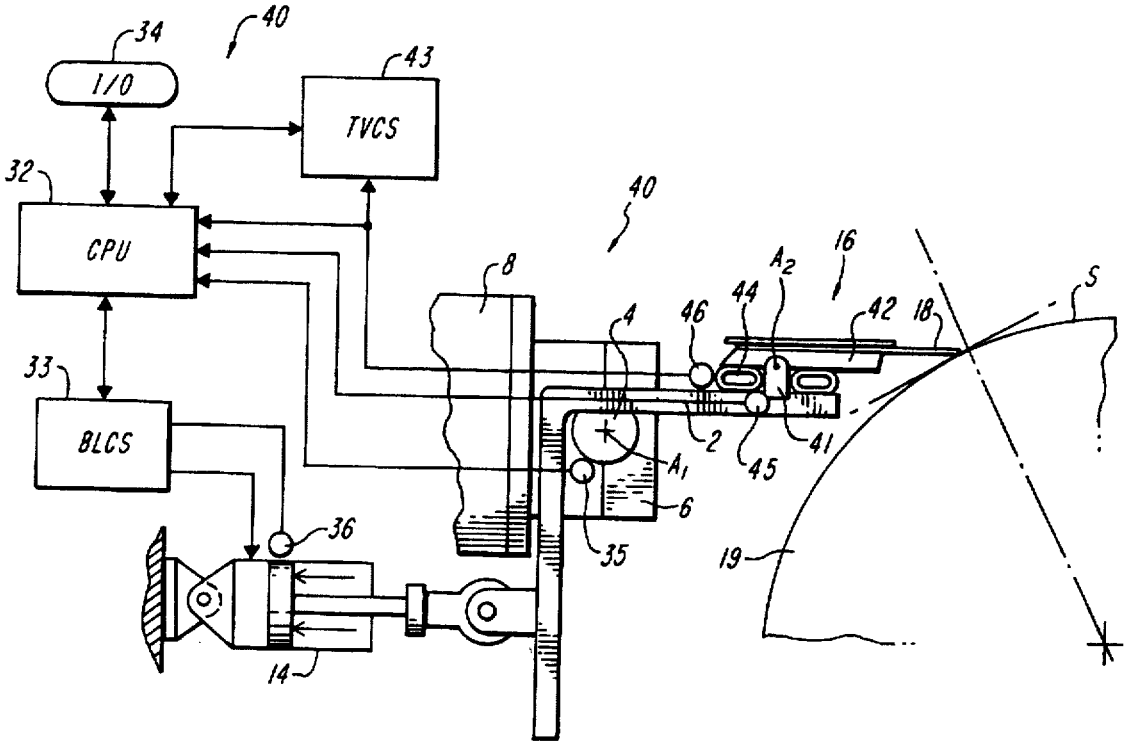
FIG. 4 shows an alternative exemplary system for measuring the deflected blade angle and the loading force in accordance with the present invention.

FIGS. 3 and 4 show exemplary systems for measuring and controlling the deflected blade angle and the loading force in real-time in accordance with the present invention. FIG. 3 shows the doctor apparatus 10 with one rotational axis, and thus one degree of freedom, as illustrated in FIG. 1 with an exemplary control system 30 in accordance with the present invention. The control system 30 includes a central processing unit (CPU) 32, such as an IBM compatible computer, and an I/O port 34 for receiving both operator parameter settings and real-time operational measurements and for displaying same. The operator parameter settings correspond to the desired blade angle and load force which are input by an operator. A blade load control system (BLCS) 33, such as an air pressure regulator, controls the pressure sent to the air cylinders serving to load the doctor blade against the rotating surface. The operational measurements are derived from sensors, for example, a sensor 35, such as a conventional absolute tilt or relative angle sensor, which measures the angular rotational position of the doctor journal 4, and a sensor 36, such as a conventional pressure transducer, which measures the pressure applied to the loading cylinders.

FIG. 4 shows an alternative doctor apparatus 40 which utilizes two pivot points rather than one. The typical doctor pivots only about its journals. An adjustable doctor apparatus pivots, in part or in whole, about an additional axis $A_2$. This introduces a second degree of freedom which accommodates independent control of blade angle and loading. One type of adjustable angle doctor system uses a pivoting holder known commercially as the Equalizer®, manufactured by Thermo Electron Web Systems of Auburn, Mass., and described in U.S. Pat. Nos. 4,789,432 and 4,906,335, incorporated herein by reference.

Built into the holder 16 is a short lever arm 42 which is acted upon by one or more flexible hydraulic tubes 44 to provide a reactionary moment about a pivot rod 41. As fluid is added the tube expands, pressing against the doctorback and the lever arm, increasing the angle between the two. Tube volume therefore controls the angle between the holder and doctor back, and thereby the blade angle. A control system 40 includes the same elements as the control system 30 of FIG. 3 with the addition of a tube volume control system (TVCS) 43. The tube fluid volume is controlled by TVCS 43, which adds or removes liquid from the tube in response to instructions from the CPU 32. A sensor 35 is utilized to ensure the angular position of the doctor journal 4 and a sensor 36 is utilized to measure the external force applied by the loading cylinders. The angular position and force measurements are then used to calculate the actual blade loading and the deflected blade angle.

Alternatively, a sensor 45 can be utilized to measure the angular position of the holder 16 about the axis $A_2$. In addition, a sensor 46, such as a conventional pressure transducer, is provided to measure the tube pressure of tubes 44. The tube pressure corresponds to the blade loading, which in turn defines blade deflection and slope. As before, these measurements can be used to calculate the actual blade loading and deflected blade angle. Other conventional force-sensing devices known to persons of skill in the art may be used to measure the externally applied load.

Figure 5A:
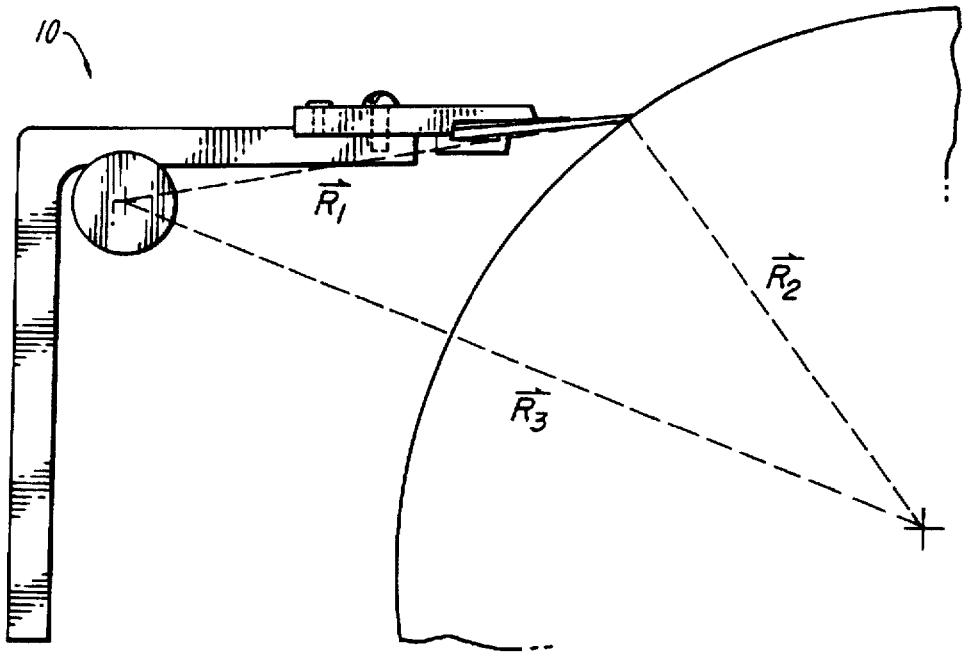
FIGS. 5A and 5B show the doctor apparatus of FIG. 3 with a corresponding kinematically modeled three-bar linkage.
Figure 5B:
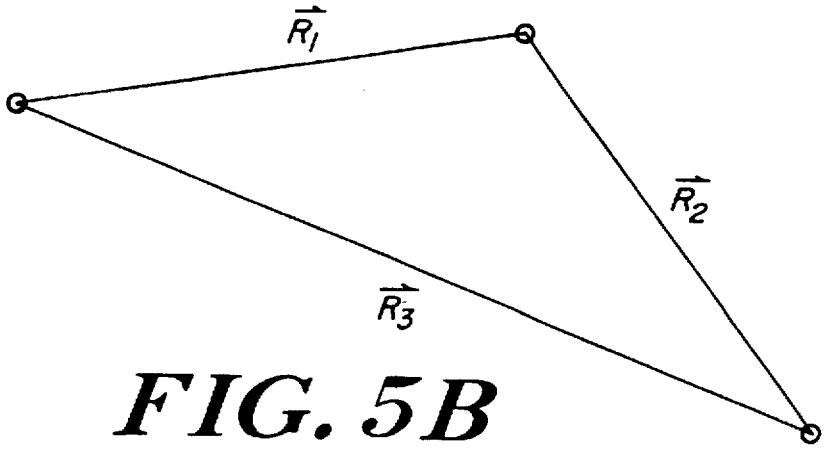
Figure 6A:
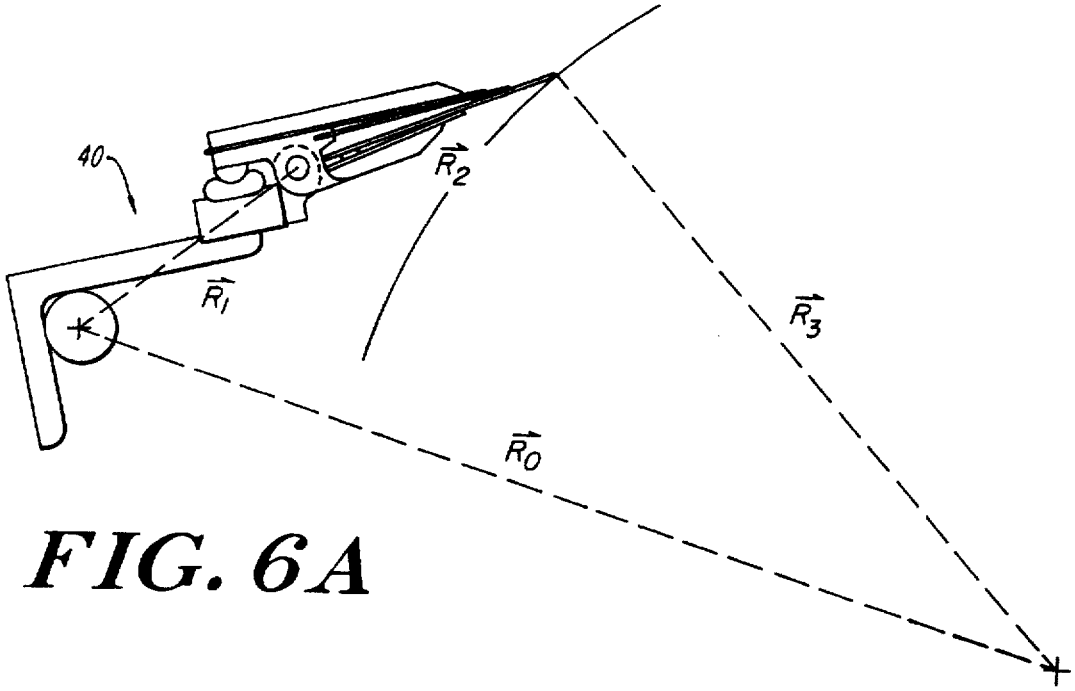
FIGS. 6A and 6B show the doctor apparatus of FIG. 4 with a corresponding kinematically modeled four-bar linkage.
Figure 6B:
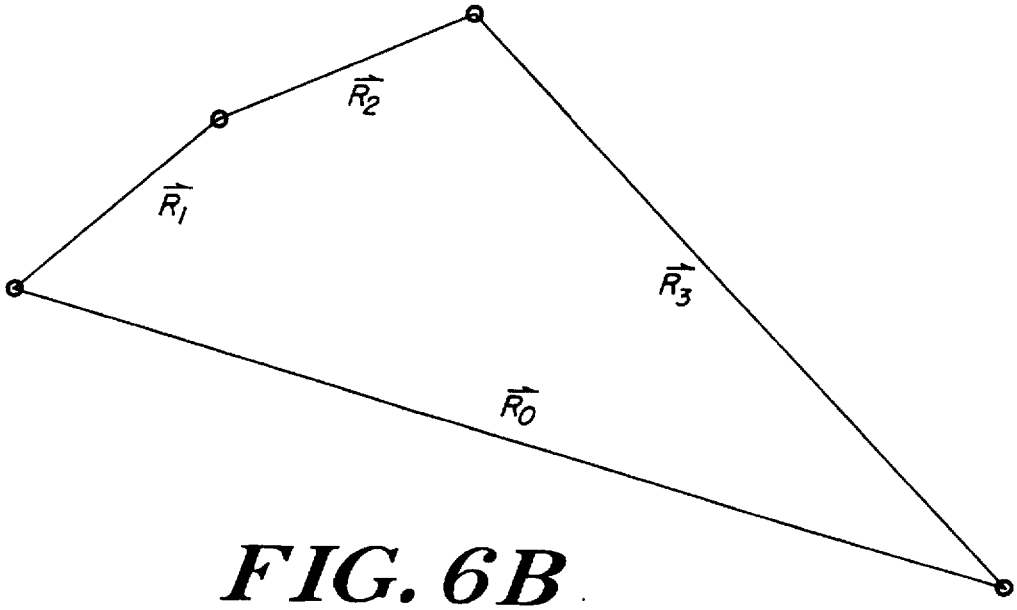

All doctor apparatus can be modeled kinematically as multi-bar linkages. In the illustrated embodiments of FIGS. 3 and 4, the doctor apparatus 10 and 40 can be modeled as three and four-bar linkages, respectively. FIG. 5A shows the doctor apparatus 10 with a modeled three-bar linkage of FIG. 5B superimposed thereon. FIGS. 6A and 6B show the doctor apparatus 40 with a corresponding four-bar linkage model.

In each of the linkage models, a portion of one link, the doctor blade, is capable of deflecting substantially under load. Accordingly, the deflected blade angle and load may be established using kinematic principles and beam deflection theory, which will be described in detail hereinafter. Doctor movement as well as the blade movement on the cylinder surface is defined using the kinematic relationships appropriate to the linkage type. If all link lengths are known, knowing the angle formed by any two links establishes the position of every link. The blade is part of one of those links. The angle the blade makes with the cylinder surface depends on two things: the position, relative to the cylinder surface, of the link containing the blade; and the blade slope at the blade-to-cylinder contact point. Doctor rotation moves the link containing the blade. The blade slope is superposed atop the link angle and completes the determination of blade angle at the contact point. The previously described angular rotation sensors determine the angle between two chosen links, which in turn defines all other link positions, including that link containing the blade. The force sensor measuring the externally applied loading force provides the information required to establish blade deflection and slope.

For purposes of illustration, an exemplary system and method for controlling the deflected blade angle and loading force in accordance with the present invention will be described with reference to an adjustable angle doctor system 40 as shown in FIG. 4. In operation, the calculated blade angle and blade load are compared to the initial setpoints for each. The difference between the two, or error signal, becomes the input to a standard Proportional-Integral-Derivative (PID) algorithm which is carried out by the CPU 32. Based on the values of three tuning parameters, the CPU in accordance with the PID algorithm outputs a scaled signal to the TVCS 43. The TVCS 43 converts the scaled PID output signal to a scaled physical response, in other words, adding or removing liquid from the tubes 44. The scaled physical response causes the blade angle to change. The TVCS moves to a position scaled to the signal received. For example, if the CPU outputs a 50% signal using a 4–20 mA current loop, a 12 mA signal would be sent to the TVCS. The TVCS in turn converts that 12 mA signal to a position representing 50% of its total movement. At regular intervals, for example every 100 milliseconds, the current doctor angle is fed back to the CPU. Thereafter, a new blade angle is calculated, compared to the setpoint and additional fluid is added or removed as necessary to converge the calculated angle to the requested setpoint.

Blade load is controlled similarly. The error between the calculated load and it's setpoint is fed to the CPU for processing in accordance with the PID algorithm. For example, for the case of pneumatic blade loading, the PID signals the air pressure regulator. The pressure regulator controls the pressure sent to two air cylinders serving to load the doctor blade against the cylinder.

Figure 7:
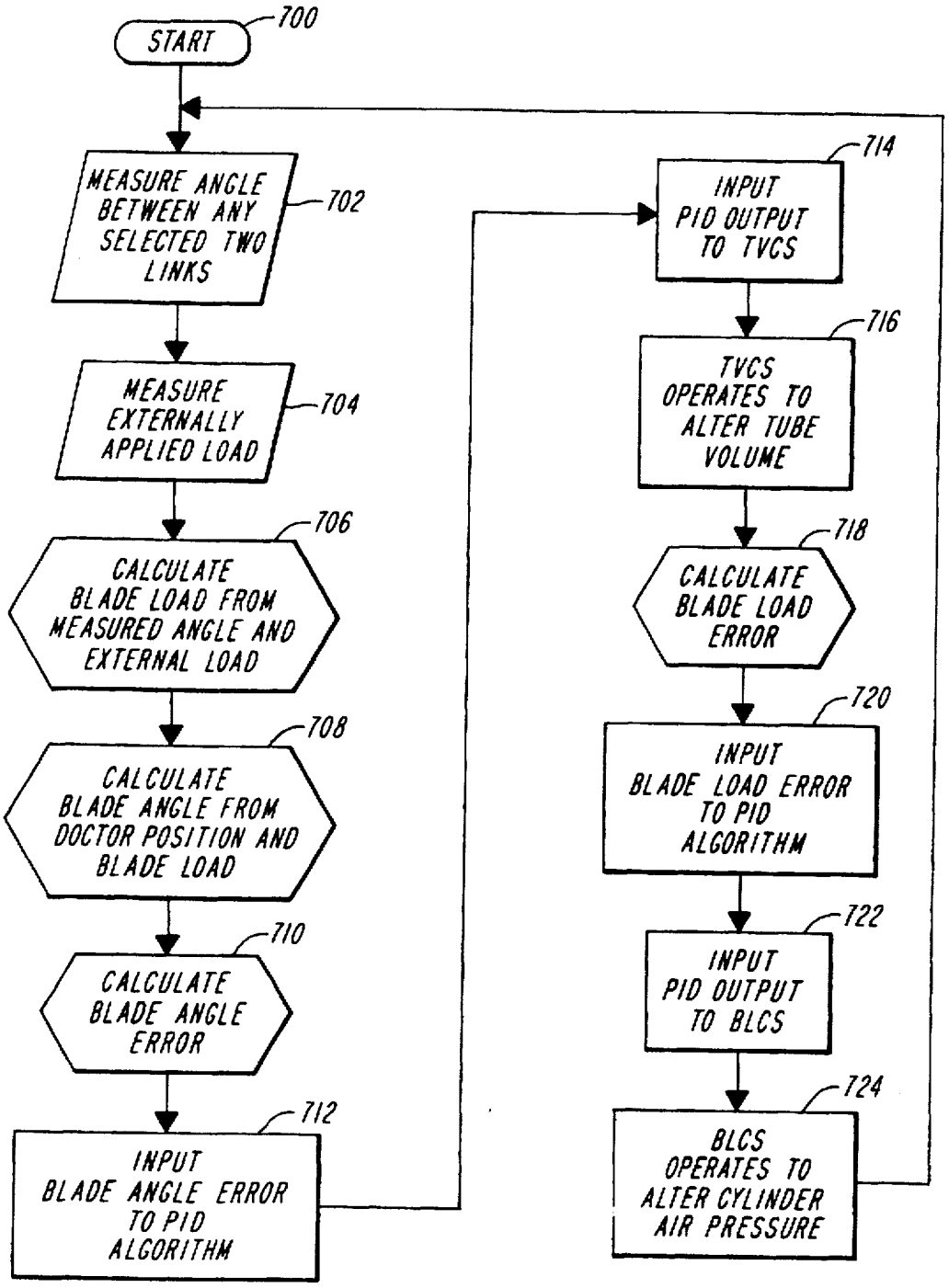
FIG. 7 shows a flowchart of the method of measuring the deflected blade angle and loading force in accordance with the present invention.

The exemplary method of measuring the deflected blade angle and loading force in accordance with the present invention is set forth hereinafter with reference to the flowchart of FIG. 7.

Initially, a measurement is made of the angle between any selected two links of the linkage model for a doctor apparatus (step 702). For example, with respect to the four-bar linkage of apparatus 40 of FIGS. 6A and 6B, this angle can be measured by the sensor 35 which is located on the doctorback. The sensor measures doctorback angle relative to horizontal. Next, a measurement is made of the externally applied load (step 704) by measuring the force applied to the doctor by the air cylinders. This measurement is carried out by using load cells mounted between each air cylinder and its mounting base. Alternative methods include measuring the tube pressure by using a pressure transducer 46 or utilizing torque sensors mounted to the doctor journals to measure the externally applied force.

The tube pressure is measured using the pressure transducer 46. An alternative method measures the force applied by air cylinders attached to the doctor. This measurement is carried out by using load cells mounted between each air cylinder and its mounting base. Torque sensors mounted to the doctor journals would also measure the externally applied force.

Thereafter, the CPU 32 calculates the blade load from the measured angle and the measured external force (step 706). Blade load is calculated using laws of static equilibrium, in particular moment balances. The various forces on the doctor (blade load, air cylinder load, friction) tend to rotate the doctor about its journal, and the holder about its pivot. Since the entire doctor apparatus is always in a quasi-steady-state with no net angular acceleration, all moments about any point (e.g. doctor journal, holder pivot) must sum to zero. The lever arms associated with each force are found from fixed structure lengths and variable angles. The angles vary with and depend solely on doctor angle and thus are known at all times. Blade load is solved directly from the moment balance. If load is measured via tube pressure, then moments are taken about the holder pivot. If load measured via air cylinder load cells, then moments are taken about the doctor journals.

The ensuing step involves the calculation of the blade angle using the doctor angle and cylinder load or tube pressure (step 708). The blade angle is computed by the CPU from knowledge of the blade link position relative to the rotating surface and from knowledge of the blade load. Blade link position provides the angle the undeflected blade makes with the rotating surface. Under load, however, the blade deflects and makes a new angle with the rotating surface. It will be appreciated by those of skill in the art that beam deflection theory accurately predicts the blade slope at the blade-to-rotating surface contact point as a function of blade load. Superimposing blade slope onto blade link angle provides the actual blade-to-rotating surface angle at the contact point.

Next, the CPU calculates the blade angle error by comparing the setpoint to the current value (step 710). The blade angle error is then input to the PID algorithm (step 712). The PID output is thereafter input to the tube volume control system 43 (step 714). In response thereto, the TVCS alters the tube volume (step 716). The CPU then calculates the blade load error by comparing the setpoint to the current value (step 718). The blade load error is subsequently then input to the PID algorithm (step 720). The PID output is then input to BLCS 33 (step 722). In turn, the BLCS alters the loading cylinders' air pressure, thus changing the blade load (step 724). Thereafter, the process returns to the initial angle measurement step (step 702).

In certain implementations, the pressure at which the blade is loaded against the roll or cylinder (PLI) is critical, while the blade angle, kept at a constant, is less important. In these instances, the method and system of the present invention can be simplified so only PLI is measured/calculated and displayed. This can be accomplished by physically measuring the angle of the blade at installation and using the measurement as a constant in the PLI calculation as described heretofore. Since the blade angle is approximated as constant, angle measuring equipment can be eliminated.

Additional methods and devices used for obtaining angle and/or PLI measurements are also deemed to be within the scope of the present invention. Examples of alternative embodiments of angle measurement are as follows.

A laser/camera striping system can be implemented so that a laser is operated along with a line generator to illuminate a line on the blade surface. At a predetermined reference point, the line would be perfectly straight. When the blade angle changes, the line becomes distorted and the associated video camera capture an image of the distorted line. The distorted line is thereafter analyzed with conventional software and utilized to calculate the blade angle.

A video or infrared camera can be arranged to take a picture of the blade contacting the roll. With respect to the infrared picture, it will be appreciated that because of friction, the point where the blade contacts the roll will be significantly higher in temperature than the remainder of the blade and holder, thus making it easily distinguishable. The photographic information from either camera is fed into the associated computer and analyzed to calculate blade angle.

It is also possible to measure the angle manually and then feed the information into the computer to calculate PLI. For example, devices such as a surveyor's transit can be used to manually measure the angle.

Ultrasonic or other frequency generators can be connected to one end of the blade and energized. A measurement is then gathered from the blade which provides a "blade frequency signature". This signature varies depending upon load and the angle of the blade contacting the roll. The signature information is then fed into the computer and analyzed to determine the angle.

The arrangement of the doctor blade and roll combination can be mimicked by an off-cylinder, multi-bar linkage system. In this configuration, the model is then connected to the doctor assembly a slave-to-master relationship. The doctor system's movements are then duplicated off-machine in a cleaner environment, where conventional data collection methods are utilized to determine angle and PLI. This information is fed into the computer and angle and/or PLI are calculated.

Examples of alternative embodiments of PLI load measurement are as follows.

In one embodiment, one or more load cells are placed directly on the doctor underneath the blade. An actual load measurement is then taken and converted to an equivalent PLI measurement. Alternatively, load cells are placed directly under the main bearings on which the roll is mounted, or in other strategically located areas, and reactive forces are measured. PLI is calculated from this information.

Strain gauges can be placed strategically on the primary blade or the back-up blade, which would in turn provide material strain information. This information is fed to a computer to calculate PLI.

A rolling diaphragm type actuator can be used to adjust blade angle and provides a means to calculate blade load PLI. The relationship between the force produced and the applied tube pressure on a rolling diaphragm actuator is very linear and repeatable. Hence, the blade load is calculated by measuring the pressure applied to the rolling diaphragm actuator.

Measurements can be taken on the roll the blade is being applied to. A frictional force is created when the blade contacts the roll. Reaction forces/torques caused by this contact are recorded in a variety of locations. These forces/torques are then interpreted and correlated to a corresponding blade PLI. Reaction forces/torques can also be easily measured at the bearings the roll is mounted on, or on the journals supporting the roll.

In place of mechanical measurements, the roll's drive system can be monitored, for example amperage, and as the blade pressure is increased, the current load on the motor will increase. This increase in amperage is measured and correlated to increases in PLI.

Figure 8A:
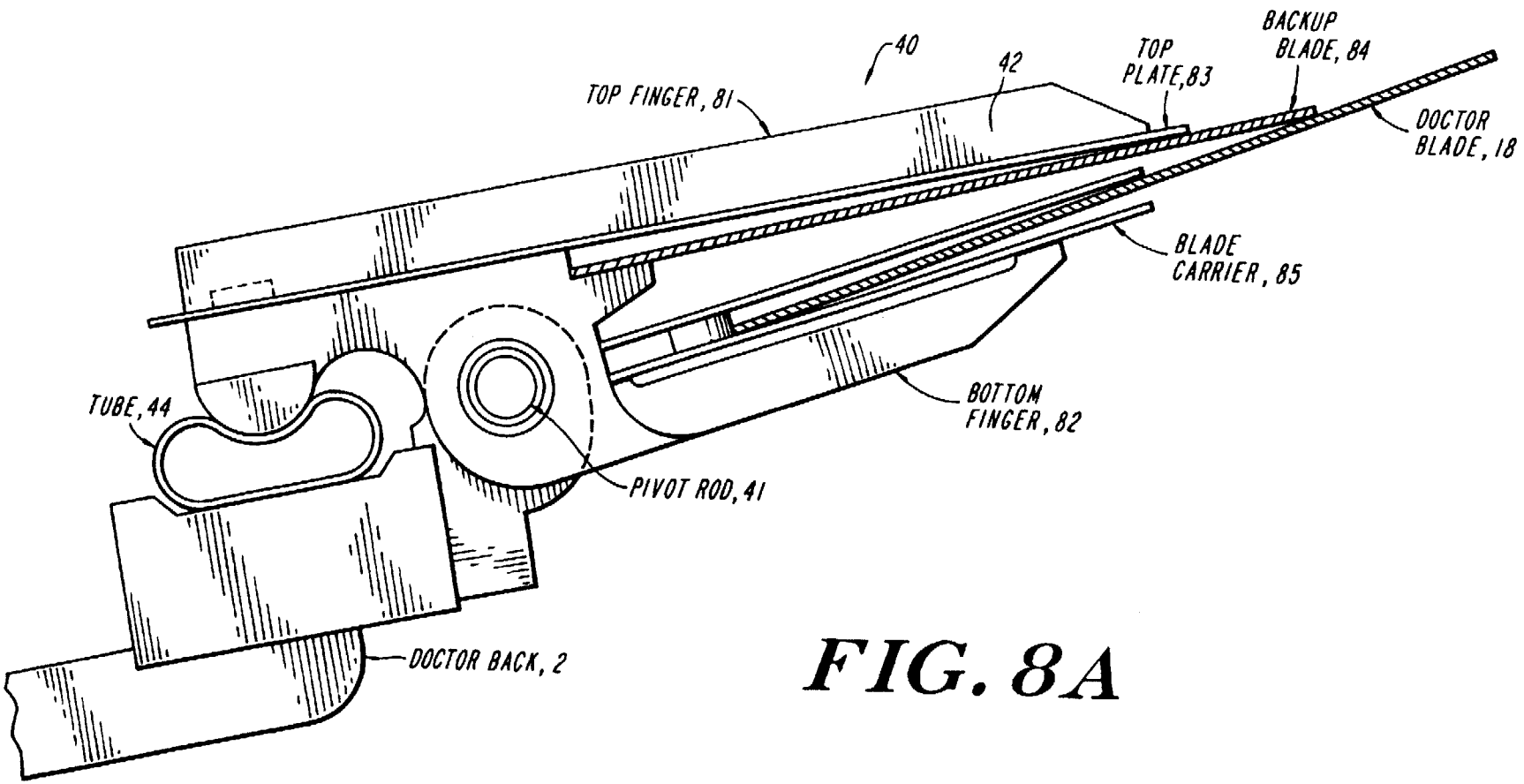
FIGS. 8A and 8B show further details of the doctoring apparatus of FIG. 4 with a corresponding vector model.
Figure 8B:
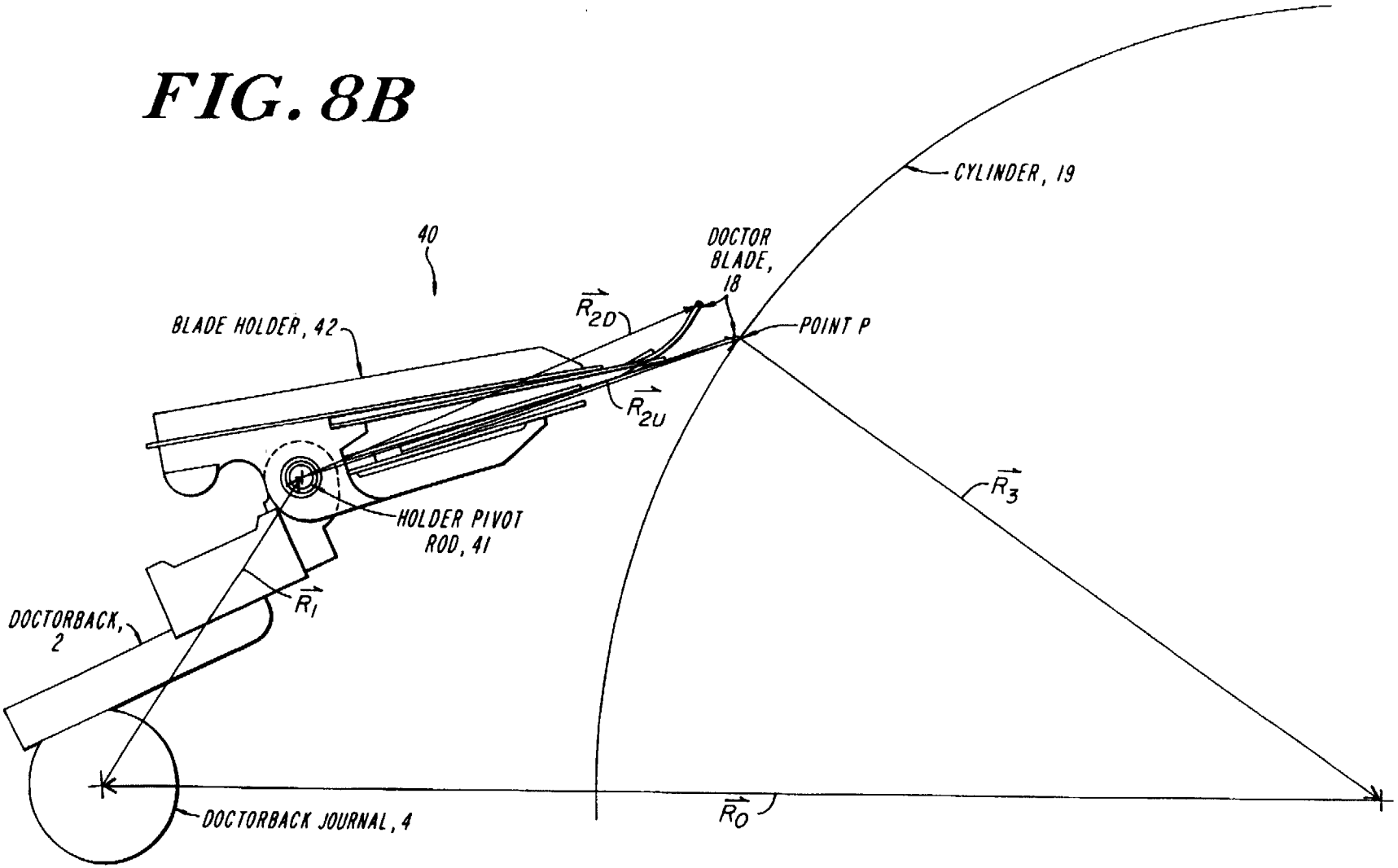
Figure 9:
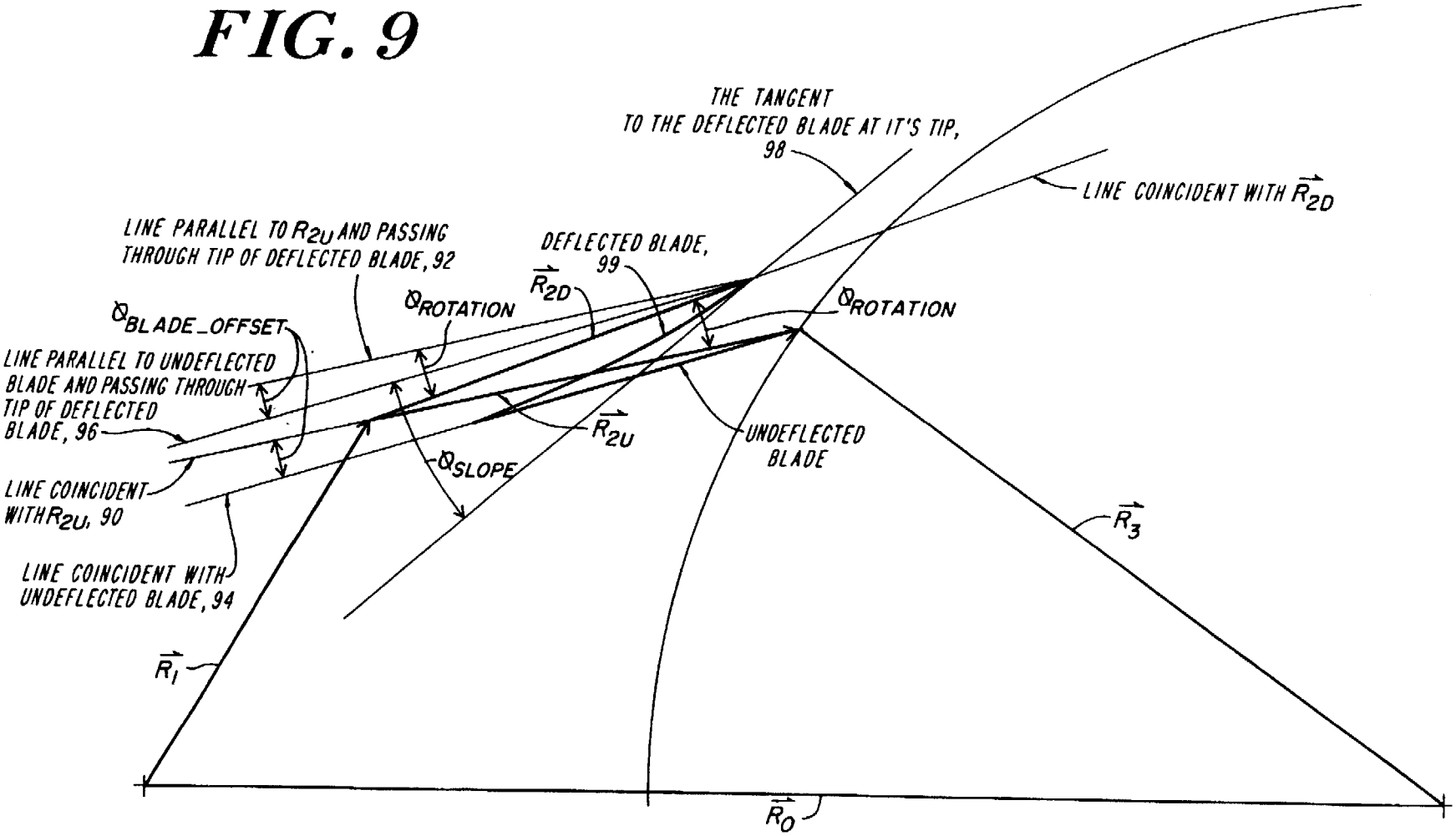
FIGS. 9 and 10 show vector models of the apparatus shown in FIG. 8B used in the geometric determination of the deflected blade angle in accordance with the present invention.
Figure 10:
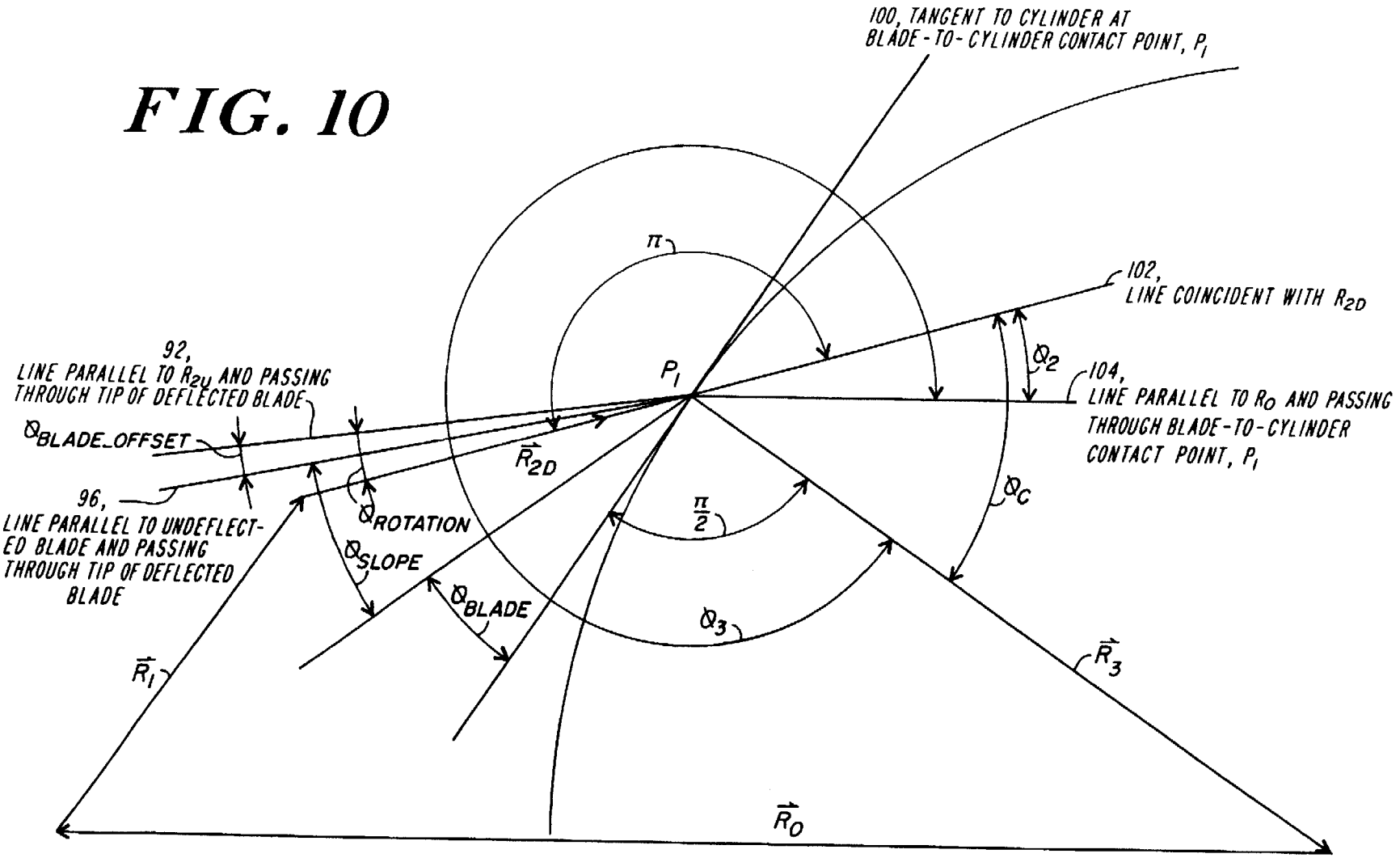

With reference now to FIGS. 8–10, the geometric determination of the deflected blade angle in accordance with the present invention will be described. The purpose of this description is to establish the validity of the following relationship which gives the doctor blade angle as a function of several measurable quantities:

$$\phi_{blade}=\pi/2+\phi_{rotation}-\phi_{slope}-\phi_{blade_offset}-\phi_c \quad (1)$$

and to derive relationships for $\phi_{rotation}$, $\phi_{slope}$, and $\phi_c$, in terms of known parameters. $\phi_{blade_offset}$ is a constant and depends on holder type. $\phi_{blade}$, the blade angle, is that angle formed between the cylinder facing blade surface and the tangent to the cylinder at the blade contact point. $\phi_{rotation}$, $\phi_{slope}$, and $\phi_c$ are defined below and are each function in whole, or in part, of blade load and doctor angle.

FIGS. 8A and 8B show a doctoring apparatus system 40 and a cylinder 19. The doctoring apparatus consists of a doctorback 2, a blade holder 42 and a doctor blade 18. The blade holder includes a top finger 81 and a bottom finger 82. The doctor blade is seated within a blade carrier 85 adjacent the bottom finger 82. A backup blade 84 is seated against a top plate 83 which is adjacent to the top finger 81. In this arrangement, the backup blade contacts the doctor blade a predetermined distance from the outer tip of the doctor blade and serves to support the doctor blade when applied to a cylinder.

The doctorback pivots about its journal 4 and the holder pivots about its pivot rod 41. The holder will pivot in response to the tube 44 being filled or emptied with a selected liquid. The doctoring apparatus is positioned such that the blade just touches the cylinder surface at some point P. Also shown is the position the blade would take if some force, acting in a direction coincident with the cylinder radius at the contact point P, was applied uniformly along its cross-machine-direction length. Assume for now that both the doctor and the holder are prevented from rotating about their pivots as the blade deflects. Several vector quantities are defined as follows:

- $\vec{K}_0$ has origin at the cylinder center and endpoint at the doctorback journal center;
- $\vec{R}_1$ has origin at the doctorback journal center and endpoint at the holder pivot center;
- $\vec{R}_{2U}$ has origin at the holder pivot center and endpoint at the blade-to-cylinder contact point P;
- $\vec{R}_3$ has origin at the cylinder center and endpoint at the blade-to-cylinder contact point P.
- $\vec{R}_{2D}$ has origin at holder pivot center and endpoint at the tip of the deflected blade.

FIG. 9 removes the doctoring apparatus hardware leaving the aforementioned vectors. Five lines, one curve and five angles are defined. The first line 90 is coincident with $R_{2U}$. The second line 92 is parallel to this first line and passes through the endpoint of vector $R_{2D}$ at the blade tip. The third line 94 is coincident with the undeflected blade. The fourth line 96 is parallel to the undeflected blade and passes through the endpoint of vector $R_{2D}$ at the blade tip. The fifth line 98 is the tangent to the deflected blade at its tip. The curved line 99 represents the shape the blade takes due to its deflection and is shown here in an arbitrary position.

The first angle, $\phi_{rotation}$, is the angle between vectors $R_{2U}$ and $R_{2D}$. The second angle is also labeled $\phi_{rotation}$ because it is geometrically equal to the previously defined $\phi_{rotation}$. This second angle is the acute angel formed by the second parallel line and the vector $-R''_{2D}$. The third angle, $\phi_{slope}$, is defined as the slope of the blade surface at the blade tip. This is the standard definition of the slope of a beam surface at its endpoint (see, for reference, *Mechanics of Materials*, Beers and Johnson, P. 496). The fourth angle, $\phi_{blade_offset}$, is the acute angle formed by vector $-R_{2U}$ and the line coincident with the undeflected blade. The fifth angle is geometrically equal to the fourth angle and is formed by the constructed parallels referred to above as lines 92 and 96.

FIG. 10 shows the vector system of FIG. 9 after it has been rotated about the doctorback journal until the deflected blade just touches the cylinder. The imaginary external force deflecting the blade in FIGS. 8 and 9 is replaced by an equal, but real, reaction force imposed by the cylinder surface. The external moment applied at the doctorback journal to maintain static equilibrium remains. As there has been no rotation of the holder about its pivot, the angles $\phi_{rotation}$, $\phi_{slope}$ and $\phi_{blade_offset}$ remain unchanged and defined as before. Vector $R_{2U}$ and the line coincident with $R_{2U}$ are not shown. The two constructed parallel lines 92 and 96 of FIG. 9 remain since they define $\phi_{blade_offset}$. Six additional angles and three lines are shown. One line 100 is the tangent to the cylinder at the new blade-to-cylinder contact point, P1. Another line 102 is coincident with the vector $R_{2D}$. The third line 104 is parallel to vector $R_0$ and passes through the new contact point P1.

The angle $\phi_2$ is defined as the that acute angle formed by vector $R_{2D}$ (line 102) and the line 104 parallel to $R_0$ passing through point P1. $\phi_c$ is the acute angle formed by vectors $R_3$ and $R_{2D}$. $\phi_3$ is that obtuse angle formed by vector $-R_3$ and the line 104 parallel to vector $R_0$ passing through point P1. $\phi_{blade}$, the blade angle, is here defined as the acute angle formed by the cylinder tangent and blade tangent, at point P1. The other two angels are constant by definition and labeled with their values, $\pi$ and $\pi/2$.

In accordance with FIG. 10, the following two statements may be made:

$$\phi_3 = \phi_2 + \pi - \phi_{rotation} + \phi_{blade_offset} + \phi_{slope} + \phi_{blade} + \frac{\pi}{2} \tag{2}$$

$$\phi_3 = 2\pi - \phi_C + \phi_2 \tag{3}$$

Solving for $\phi_{blade}$ gives $$\phi_{blade} = \frac{\pi}{2} + \phi_{rotation} - \phi_{slope} - \phi_{blade_offset} - \phi_C \tag{4}$$

Hereinafter, description will be provided to show the derivations of $\phi_{Rotation}$ and $\phi_{slope}$, respectively, as functions of blade deflections; the derivations of relationships for blade deflections based on blade load; and the derivation that $\phi_c$ is dependent on a measurement of angular displacement of a link in the doctor system.

Figure 11:
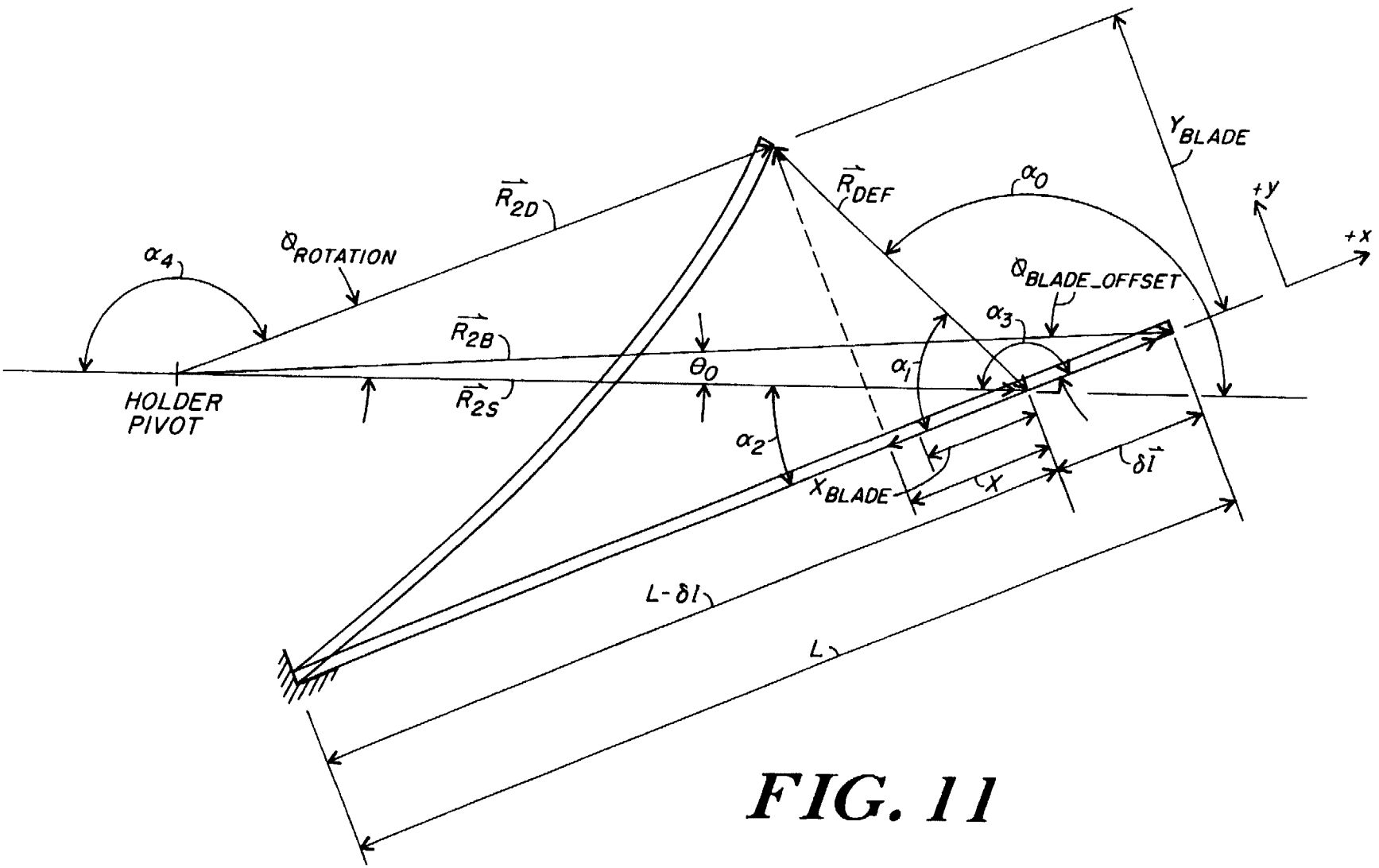
FIGS. 11 and 12A–C show vector models of a non-deflected and deflected blade used to derive the angle $\phi_{Rotation}$ established in the analysis of the vector models of FIGS. 9 and 10.
Figure 12A:
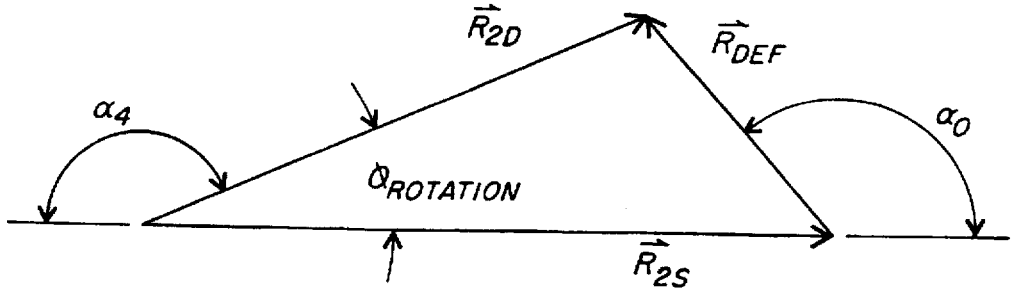

With reference now to FIGS. 11 and 12A–C, the derivation of $\phi_{Rotation}$ will be described. FIG. 11 shows an undeflected doctor blade and the same blade in its post-deflection position. Also identified is the holder pivot center. This drawing is not to scale and the deflections and angles are exaggerated for illustrative purposes. A description of the labeled quantities are as follows:

$R_{2B}$=a vector with origin at the holder pivot center and endpoint at the tip of a blade of base length. This base length is always known, e.g. 3–5 inches;

$\delta 1$=the amount by which the base blade is arbitrarily shortened;

$R_{2S}$ a vector with origin at the holder pivot center and endpoint located at some distance $\delta 1$ down the blade surface from the tip of the base blade;

$R_{2D}$=a vector with origin at the holder pivot and endpoint at the tip of the foreshortened, rotated base blade;

$\phi_{Rotation}$=the angle formed by vectors $R_{2S}$ and $R_{2D}$;

$R_{DEF}$=a vector with origin at the tip of the foreshortened base blade and endpoint at the tip of the rotated, foreshortened base blade. It is the vector quantity that when added to vector $R_{2S}$ results in the vector $R_{2D}$;

L=the length of the base blade;

$X_{blade}$=amount the blade is compressed, in the $-x$ direction, by a load imposed at the blade tip;

$Y_{blade}$=distance between cylinder-facing base blade surface and the tip of the rotated, foreshortened base blade;

X=the distance, measured along the base blade, between the tip of the foreshortened, compressed base blade and the horizontal projection onto the base blade of the rotated, foreshortened base blade;

$\phi_{blade_offset}$=acute angle formed by the vector $-R_{2B}$ and the base blade's cylinder-facing surface;

$\theta_0$=acute angle formed by the vectors $R_{2B}$ and $R_{2S}$;

$\alpha_0$=obtuse angle formed by the vectors $R_{2S}$ and $R_{DEF}$;

$\alpha_1$=acute angle formed the vector $R_{DEF}$ and the base blade's cylinder-facing surface;

$\alpha_2$=acute angle formed by the vector $-R_{2S}$ and the base blade's cylinder-facing surface;

$\alpha_3$=obtuse angle formed by the vector $-R_{2S}$ and the base blade's cylinder-facing surface. $\alpha_3$ is the supplement of $\alpha_2$;

$\alpha_4$=supplement of $\phi_{Rotation}$;

The angle $\phi_{Rotation}$ may be found from an examination of the triangle formed by vectors $R_{2S}$, $R_{2D}$ and $R_{DEF}$. Referring to FIG. 12A, the following statement may be made:

$$\vec{R}_{2D} - \vec{R}_{2S} = \vec{R}_{DEF} \tag{5}$$

Taking the inner vector product ("dot" product) of each side with itself gives:

$$(\vec{R}_{2D} - \vec{R}_{2S}) \cdot (\vec{R}_{2D} - \vec{R}_{2S}) = \vec{R}_{DEF} \cdot \vec{R}_{DEF} \tag{6}$$

Using the definition of inner product, simplifying and solving for $\phi_{Rotation}$:

$$R_{DEF}^2 = R_{2D}^2 - 2 \times R_{2D} \times R_{2S} \times \cos(\alpha_4) + R_{2S}^2 \tag{7}$$

$$\cos(\alpha_4) = -\cos(\phi_{Rotation})$$

$$\phi_{rotation} = a\cos\left[\frac{R_{2D}^2 + R_{2S}^2 - R_{DEF}^2}{2 \times R_{2D} \times R_{2S}}\right] \tag{8}$$

Rewriting the same vector triangle in order to find $R_{2D}$:

$$\vec{R}_{2D} = \vec{R}_{2S} + \vec{R}_{DEF} \tag{9}$$

Again taking the inner vector product of each side with itself and solving for $R_{2D}$:

$$R_{2D} = (R_{2S}^2 - 2 \times R_{2S} \times R_{DEF} \times \cos(\pi - \alpha_0) + R_{DEF}^2)^{0.5} \tag{10}$$

There are three unknowns in the above equations: $\alpha_0$, $R_{2S}$, and $R_{DEF}$. From FIG. 11, by inspection:

$$\alpha_0 + (\alpha_1 - \alpha_2) = \pi$$

(Supplementary angle sum to $\pi$ radians).

Rearranging $$\pi - \alpha_0 = \alpha_1 - \alpha_2$$

Also, by inspection of FIG. 11

$$\alpha_2 + \alpha_3 = \pi$$

and from triangle $R_{2S}$–$\delta 1$–$R_{2B}$ $$\theta_0 + \alpha_3 + \phi_{blade_offset} = \pi$$

(The angles of a triangle sum to $\pi$ radians).

Combining the above three equations and solving for $(\pi - \alpha_0)$ $$(\pi - \alpha_0) = \alpha_1 - \theta_0 - \phi_{blade_offset}$$

Figure 12B:
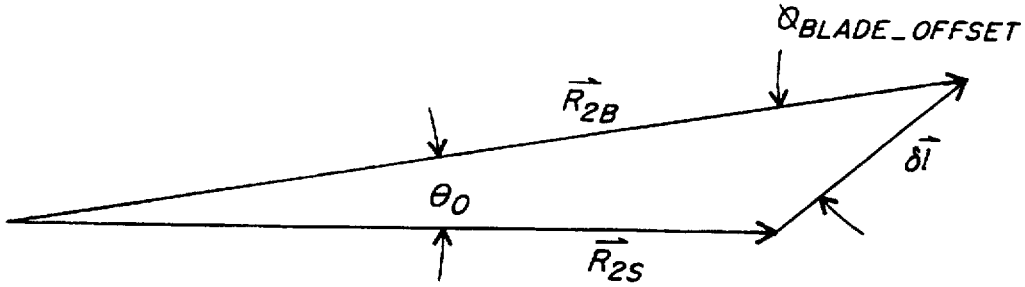
Figure 12C:
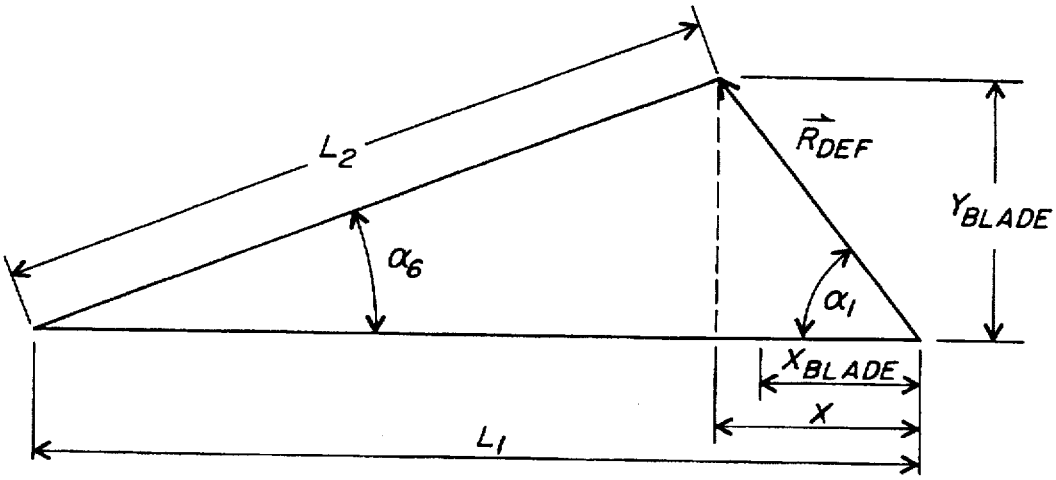

Referring now to FIG. 12B which shows the triangle composed of vectors $R_{2S}$, $R_{2B}$ and $\delta 1$, the following statement can be made:

$$\vec{R}_{2S}=\vec{R}_{2B}-\delta\vec{1} \tag{11}$$

Taking the inner vector product of each side with itself and solving for $R_{2S}$:

$$R_{2S}=(R_{2B}^2-2\cdot R_{2B}\cdot\delta 1\cdot\cos(\phi_{blade_offset})+\delta 1^2)^{0.5} \tag{12}$$

Rewriting the same vector triangle and solving for $\theta_0$:

$$\vec{R}_{2B}-\vec{R}_{2S}=\delta\vec{1} \tag{13}$$

$$R_{2B}^2-2\cdot R_{2B}\cdot R_{2S}\cdot\cos(\theta_0)+R_{2S}^2=\delta 1^2 \tag{14}$$

$$\theta_0=a\cos\left[\frac{R_{2B}^2+R_{2S}^2-\delta 1^2}{2\cdot R_{2B}\cdot R_{2S}}\right] \tag{15}$$

Substituting the previously determined equation for $R_{2S}$ in the equation for $\theta_0$ and simplifying gives:

$$\theta_0=a\cos\left[\frac{R_{2B}-\delta 1\cdot\cos(\phi_{blade_offset})}{(R_{2B}^2-2\cdot R_{2B}\cdot\delta 1\cdot\cos(\phi_{blade_offset}))^{0.5}}\right] \tag{16}$$

Referring to Drawing #4, $R_{DEF}$ is given as:

$$R_{DEF}=(X^2+Y_{blade}^2)^{0.5}$$

Finding the value of X requires some intermediate steps. From FIG. 12C:

$$L_1=L-\delta 1 \text{ (From Drawing \#1)} \tag{17}$$

$$L_2=L_1-X_{blade}$$

$$\delta_6=a\sin\left[\frac{Y_{blade}}{L_2}\right]$$

$$L_1-X=L_2\cdot\cos(\alpha_6)=(L-\delta 1-X_{balde})\cdot\cos\left(a\sin\left(\frac{Y_{blade}}{L-\delta 1-X_{blade}}\right)\right)$$

Substituting L–δ1 for $L_1$ and solving for X $$X=L-\delta 1-(L-\delta 1-X_{blade})\cdot\cos\left[a\sin\left(\frac{Y_{blade}}{L-\delta 1-X_{blade}}\right)\right] \tag{18}$$

This equation, when substituted into that for $R_{DEF}$ above, shows $R_{DEF}$ to be a function entirely of the X and Y-deflection of the blade.

$$R_{DEF}=\left(\left((L-\delta 1-(L-\delta 1-X_{blade})\cdot\cos\left[a\sin\left(\frac{Y_{blade}}{L-\delta 1-X_{blade}}\right)\right]\right)^2+Y_{blade}^2\right)^{0.5} \tag{19}$$

To complete this derivation, the value of $\alpha_1$ must be found. From FIG. 12C:

$$\alpha_1=a\tan\left[\frac{Y_{blade}}{X}\right]$$

Substituting for X $$\alpha_1=a\tan\left[\frac{Y_{blade}}{L-\delta 1-(L-\delta 1-X_{blade})\cdot\cos\left[a\sin\left(\frac{Y_{blade}}{L-\delta 1=X_{blade}}\right)\right]}\right] \tag{20}$$

Summarizing, $$\phi_{Rotation}=a\cos\left[\frac{R_{2D}^2+R_{2S}^2-R_{DEF}^2}{2\cdot R_{2D}\cdot R_{2S}}\right]$$

$$R_{2D}=(R_{2S}^2-2\cdot R_{2S}\cdot R_{DEF}\cdot\cos(\pi-\alpha_0)+R_{DEF}^2)^{0.5}$$

$$R_{2S}=(R_{2B}^2-2\cdot R_{2B}\cdot\delta 1\cdot\cos(\phi_{blade_offset})+\delta 1^2)^{0.5}$$

$$(\pi-\alpha_0)=\alpha_1-\theta_0-\phi_{blade_offset}$$

$$\alpha_1=a\tan\left[\frac{Y_{blade}}{L-\delta 1-(L-\delta 1-X_{blade})\cdot\cos\left[a\sin\left(\frac{Y_{blade}}{L-\delta 1-X_{blade}}\right)\right]}\right] \tag{21}$$

$$\theta_0=a\cos\left[\frac{R_{2B}-\delta 1\cdot\cos(\phi_{blade_offset})}{(R_{2B}^2-2\cdot R_{2B}\cdot\delta 1\cdot\cos(\phi_{blade_offset}))^{0.5}}\right] \tag{22}$$

$$R_{DEF}=\left(\left(L-\delta 1-(L-\delta 1-X_{blade})\cdot\cos\left[a\sin\left(\frac{Y_{blade}}{L-\delta 1-X_{blade}}\right)\right]\right)^2+Y_{blade}^2\right)^{0.5} \tag{23}$$

At this point the unknowns in the above seven equations are:

$X_{blade}$
$Y_{blade}$
L
δ1
$\phi_{blade_offset}$
$R_{2B}$

Of these six quantities, all but the first two are constant with holder design. That is, for a given holder type, L, δ1, $\phi_{blade_offset}$ and $R_{2B}$ are fixed. Only $X_{blade}$ and $Y_{blade}$ vary with blade angle and load. This variance is predictable and is discussed in more detail hereinafter with a description of blade deflections using strain energy methods.

The strain energy method used to determine the slope of the doctor blade due to a load imposed at its tip will be described hereinafter. This load, conventionally known as the blade load, will hereafter be referred to as PLI. A complete description of the well known strain energy method can be found in texts on mechanics, such as *Mechanics of Materials*, Chapter 10-Energy Methods, Beer and Johnson, McGraw-Hill, 1981.

Strain energy is the energy stored in a material as an external force or moment acts to stretch, compress or bend the material. This stored energy is completely analogous to the energy stored in a spring as it is stretched or compressed or in a beam as it is twisted or bent. In equation form the work done by an axial force is:

$$dU=P*dx$$

where:

P=external load applied to material
dx=small length change of the material caused by load P
dU=small amount of work done by load P over distance dx The total strain energy of a given piece of material is found by integrating the above equation over the length of the material $$U=\int_0^{x_1} P dx \tag{24}$$

To eliminate the physical size characteristics of the material, divide through by volume V=A*L, which gives the strain energy density:

$$\frac{U}{V}=\int_0^{x_1} \frac{P}{A} \frac{dx}{L} \tag{25}$$

Since P/A is the normal stress $\sigma_x$ and dx/L is the normal strain $\epsilon_x$, it follows that $$u=\frac{U}{V}=\int_0^{x_1} \sigma_x d\epsilon_x \tag{26}$$

where u is the strain energy density.

And since $\sigma_x=E\epsilon_x$ $$u=\int_0^{x_1} E\epsilon_x d\epsilon_x=\frac{E\epsilon_1^2}{2} \tag{27}$$

For a general, non-uniform stress distribution, the strain energy density must be defined as $$u=\lim_{\Delta V\to 0} \frac{\Delta U}{\Delta V} \tag{28}$$

or $$u \frac{dU}{dV} \tag{29}$$

If the stress stays within the proportional limit, then $\sigma_x=E\epsilon_x$ and $$u=\frac{1}{2} E\epsilon_x^2=\frac{1}{2} \sigma_x\epsilon_x=\frac{1}{2} \frac{\sigma_x^2}{E} \tag{30}$$

Solving $$u=\frac{dU}{dV}$$

for dU, substituting the above relationship for u and integrating gives $$U=\int u dV=\int \frac{\sigma_x^2}{2E} dV \tag{31}$$

For the case of bending beams, the normal stress, $\sigma_x$ is given by $$\sigma_x=\frac{My}{I}$$

and dV is given by dV=dA dx. After substituting both into the above equation for strain energy one gets $$U=\int \frac{M^2y^2}{2EI^2} dAdx \tag{32}$$

Since $$\frac{M^2}{2EI^2} dx$$

is a function solely of x and $\int y^2 dA$ is the moment of inertia about the bodies' neutral axis, I, the above equation reduces to $$U=\int_0^L \frac{M^2}{2EI} dx \tag{33}$$

A theorem in mechanics known as Castigliano's Theorem states that if an elastic structure is subjected to n loads $P_1$, $P_2$, . . . . $P_n$, the deflection $x_j$ of the point of application of $P_j$, measured along the line of action of $P_j$, may be expressed as the partial derivative of the strain energy of the structure with respect to the load $P_j^1$. This is written as $$x_j=\frac{\partial U}{\partial P_j} \tag{34}$$

Analogously, Castigliano's Theorem may be used to determine the slope of a beam at the point of application of a couple $M_j$ $$\theta_j=\frac{\partial U}{\partial M_j} \tag{35}$$

since the work done by a couple (and strain energy stored) is given by $$dU=Md\theta$$

The procedure then for determining the slope of an elastic structure (doctor blade and backup blade system) at a particular point is 1. Find the moment equation for the structure;
2. Compose the strain energy equation of the structure using the above equations;
3. Differentiate the strain energy equation with respect to the couple imposed at the point in question (i.e. the doctor blade tip). If no couple exists at the point of interest, impose a dummy couple, Q, then differentiate with respect to Q, then set Q=0;
4. Integrate the resulting equation, with respect to x, over the structure's length.

This procedure differentiates before integrating to simplify the process, making use of the following:

$$\theta_T=\frac{\partial U}{\partial M_T}=\int_0^L \frac{\partial\left(\frac{M_T^2}{2EI}\right)}{\partial M_T} dx \tag{36}$$

The above procedure is applied to the "elastic structure" of doctor blade and backup blade system supported by a holder as shown in FIG. 8A.

Figure 13:
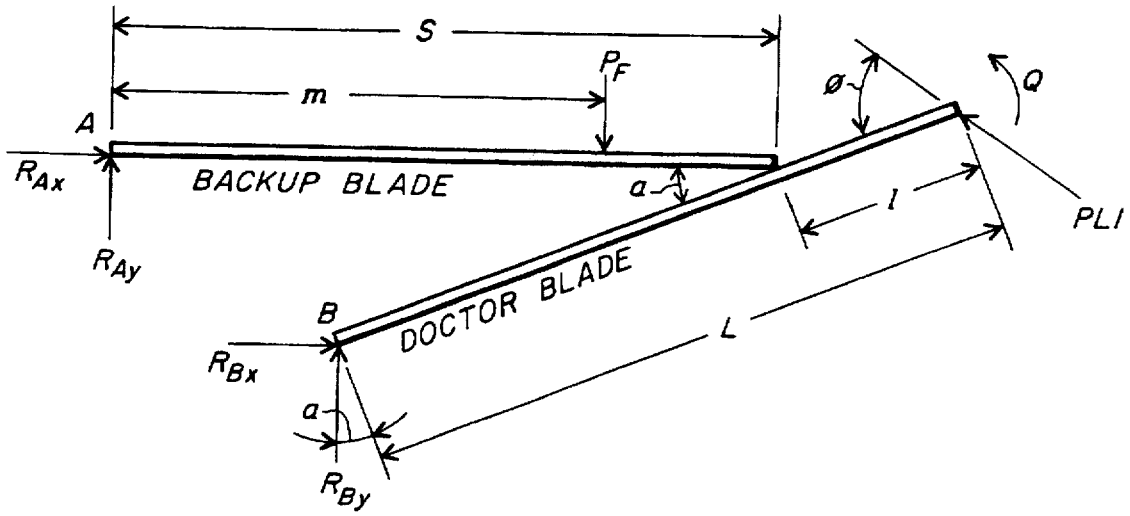
FIGS. 13, 14, 15, 16A, B, 17A, B, and 18 show vector models of the doctor blade and the backup blade used to derive blade slope and blade deflections.

FIG. 13 shows the doctor blade and backup blade with imposed blade load (PLI), a "dummy" or imaginary couple (Q) imposed at the doctor blade tip and the holder-supplied reaction forces, $R_A$ and $R_B$, appearing at the supported ends of each blade. First the reactions are determined for each blade, then moment equations are formed.

Figure 14:
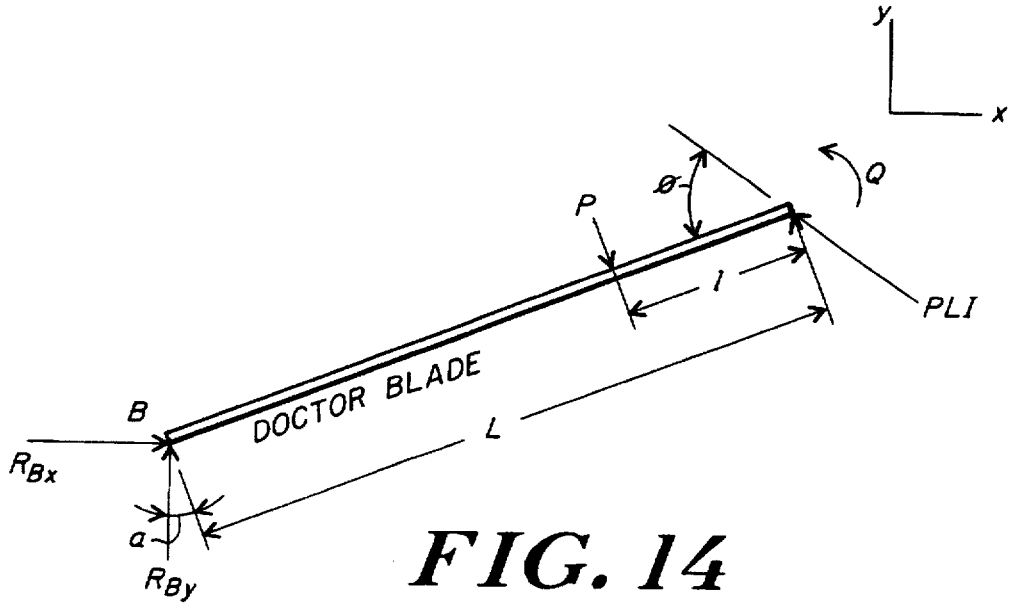

Initially, the reaction forces for each blade must be determined. With reference to FIG. 14 showing the doctor blade, static equilibrium requires moments about point B sum to zero:

$$\Sigma M_B=0$$

$$-(PLI*\sin\phi)*L+P*(L-1)-Q=0$$

Solving for P $$P=\frac{PLI*\sin\phi*L+Q}{(L-1)} \quad (37)$$

Static equilibrium requires forces acting in y-direction sum to zero:

$$\Sigma F_x=0$$

$$R_{BX}-PLI*\cos(\phi-\alpha)+P*\sin(\alpha)+P*\sin(\alpha)=0.$$

Solving for $R_{BX}$ and substituting for P $$R_{Bx}=PLI*\cos(\phi-\alpha)-P*\sin(\alpha) \quad (38)$$

$$R_{Bx}=PLI*\cos(\phi-\alpha)-\frac{(PLI*\sin(\phi)*L+Q}{L-1}*\sin(\alpha)$$

Separating the terms associated with the dummy couple, Q, $$R_{Bx}=PLI*\left[\cos(\phi-\alpha)-\sin(\phi)*\sin(\alpha)*\frac{L}{(L-1)}\right]-Q*\frac{\sin(\alpha)}{(L-1)} \quad (39)$$

Static equilibrium requires forces acting in x-direction sum to zero:

$$\Sigma F_y=0$$

$$R_{By}-P*\cos(\alpha)+PLI*\sin(\phi-\alpha)=0$$

Solving for $R_{By}$ and substituting for P $$R_{By}=P*\cos(\alpha)-PLI*\sin(\phi-\alpha) \quad (40)$$

$$R_{By}=\frac{(PLI*\sin(\phi)*L+Q)}{(L-1)}*\cos(\alpha)-PLI*\sin(\phi-\alpha)$$

Again, separating the terms associated with the dummy couple, Q, $$R_{By}=PLI*\left[\sin(\phi)*\cos(\alpha)*\frac{L}{(L-1)}-\sin(\phi-\alpha)\right]+\frac{Q*\cos(\alpha)}{(L-1)} \quad (41)$$

Summarizing, the forces acting on the doctor blade are:

$$P=\frac{PLI*\sin(\phi)*L+Q}{(L-1)} \quad (42)$$

$$R_{Bx}=PLI*\left[\cos(\phi-\alpha)-\sin(\phi)*\sin(\alpha)*\frac{L}{(L-1)}\right]-Q*\frac{\sin(\alpha)}{(L-1)} \quad (43)$$

$$R_{By}=PLI*\left[\sin(\phi)*\cos(\alpha)*\frac{L}{(L-1)}-\sin(\phi-\alpha)\right]+\frac{Q*\cos(\alpha)}{(L-1)} \quad (44)$$

Figure 15:
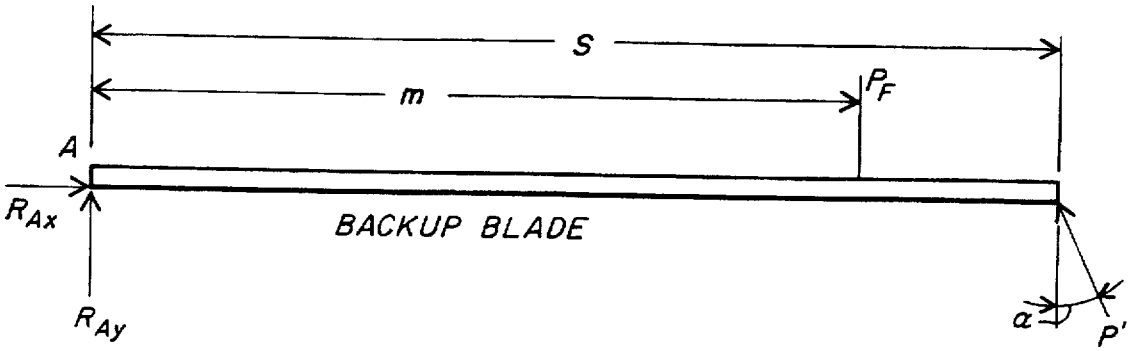

With reference now to FIG. 15 showing the backup blade, static equilibrium requires moments about point A sum to zero:

$$\Sigma M_A=0$$

$$P_F*m-P'*\cos(\alpha)*s=0$$

Solving for $P_F$ $$P_F*\frac{P'*\cos(\alpha)*s}{m} \quad (45)$$

Since, by examination, |P'|=|P|, substituting P from the doctor blade analysis for P' gives $$P_F=\left[PLI*\sin(\phi)*\left(\frac{L}{(L-1)}\right)+\frac{Q}{(L-1)}\right]*\cos(\alpha)*\frac{s}{m} \quad (46)$$

Separating the terms associated with the dummy couple, Q, gives:

$$P_F=PLI*\sin(\phi)*\cos(\alpha)*\left(\frac{L}{(L-1)}\right)*\frac{s}{m}+\frac{Q}{(L-1)}*\cos(\alpha)*\frac{s}{m} \quad (47)$$

Static equilibrium requires forces acting in x-direction sum to zero:

$$\Sigma F_x=0$$

$$R_{Ax}-P'*\sin(\alpha)=0$$

Solving for $R_{Ax}$, substituting for P' and separating terms associated with the dummy couple, Q, $$R_{Ax}=PLI*\sin(\phi)*\sin(\alpha)\left(\frac{L}{L-1}\right)+\frac{Q}{L-1}*\sin(\alpha) \quad (48)$$

Static equilibrium requires forces acting in y-direction sum to zero:

$$\Sigma F_y=0$$

$$R_{Ay}-P_F+P'*\cos(\alpha)=0$$

Solving for $R_{Ay}$ $$R_{Ay}=P_F-P'*\cos(\alpha)$$

Substituting for P and P' and separating the terms associated with the dummy couple Q gives:

$$R_{Ay}=PLI*\sin(\phi)*\cos(\alpha)*\frac{L}{L-1}*\left[\frac{s}{m}-1\right]+\frac{Q}{L-1}*\cos(\alpha)*\left[\frac{s}{m}-1\right] \quad (49)$$

Summarizing, $$P_F=PLI*\sin(\phi)*\cos(\alpha)*\left(\frac{L}{(L-1)}\right)*\frac{s}{m}+\frac{Q}{(L-1)}*\cos(\alpha)*\frac{s}{m} \quad (50)$$

$$R_{Ax}=PLI*\sin(\phi)*\sin(\alpha)*\left(\frac{L}{L-1}\right)+\frac{Q}{L-1}*\sin(\alpha) \quad (51)$$

$$R_{Ay}=PLI*\sin(\phi)*\cos(\alpha)*\frac{L}{L-1}*\left[\frac{s}{m}-1\right]+\frac{Q}{L-1}*\cos(\alpha)*\left[\frac{s}{m}-1\right] \quad (52)$$

Figure 16A:
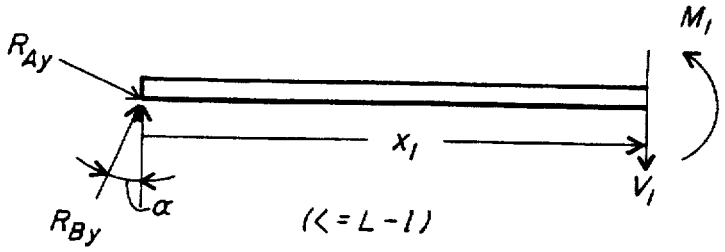

Next, the moment equations for each section of each blade must be determined. With reference to FIG. 16A, the moment equation for a first section of the doctor blade is:

$$R_{By}*\cos(\alpha)*x_1-R_{Bx}*\sin(\alpha)*x_1-M_1=0$$

$$M_1=[R_{By}*\cos(\alpha)-R_{Bx}*\sin(\alpha)]*x_1$$

Substituting for $R_{By}$ gives the moment equation for the first section of the doctor blade as $$M_1=\left[\left(PLI*\left(\sin(\phi)*\cos(\alpha)*\frac{L}{(L-1)}-\sin(\phi-\alpha)\right)+Q*\frac{\cos(\alpha)}{(L-1)}\right]*\cos(\alpha)\right]*x_1-[(PLI*(\cos(\phi-\alpha)- \quad (53)$$

-continued $$\sin(\phi)*\sin(\alpha)*\frac{L}{(L-1)}\Big)-Q*\frac{\sin(\alpha)}{(L-1)}\Big)*\sin(\alpha)\Big]*x_1$$

Using the following trigonometric identities $$\sin(a+b)=\sin a*\cos b+\cos a*\sin b$$

$$\cos(a+b)=\cos a*\cos b-\sin a*\sin b$$

and applying them to the quantities $\sin(\phi-\alpha)$ and $\cos(\phi-\alpha)$ and using the identity $\cos^2\alpha+\sin^2\alpha=1$, the above relationship for $M_1$ becomes:

$$M_1=PLI*\sin(\phi)*\left[\frac{L}{L-1}-1\right]*x_1=Q*\frac{x_1}{L-1} \quad (54)$$

$$(x_1 \leqq L-1)$$

For the second section of the doctor blade shown in FIG. 15B, the moment equation is found from $$M_1'-PLI*\sin(\phi)*x_1'-Q=0$$

$$M_1'=PLI*\sin(\phi)*x_1'+Q \quad (x_1' \leqq 1)$$

Figure 17A:
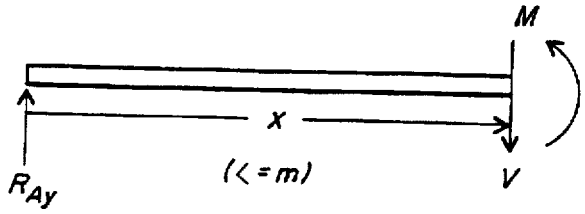

For a first section of the backup blade as shown in FIG. 17A, the moment equation is found from $$R_{Ay}*x-M=0$$

$$M=R_{Ay}*x$$

Substituting for $R_{Ay}$ gives $$M=PLI*\sin(\phi)*\cos(\alpha)*\left(\frac{L}{L-1}\right)*\left[\frac{s}{m}-1\right]*x+\frac{Q}{L-1}*\cos(\alpha)*\left[\frac{s}{m}-1\right]*x \quad (x \leqq m) \quad (55)$$

Figure 17B:
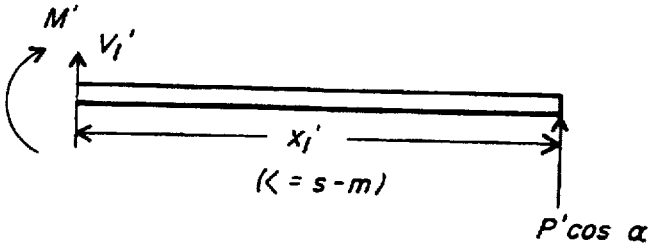

For a second section of the backup blade as shown in FIG. 17B, the moment equation is $$M'-P'*\cos(\alpha)*x'=0$$

$$M'=P'*\cos(\alpha)*x'$$

Substituting for P' and separating the terms associated with the dummy couple, Q $$M'=PLI*\sin(\phi)*\cos(\alpha)*\left(\frac{L}{L-1}\right)*x'+\left(\frac{Q}{L-1}\right)*\cos(\alpha)*x' \quad (x' \leqq s-m) \quad (56)$$

Summarizing, the four blade sections' moment equations are:

For the doctor blade:

$$M_1=PLI*\sin(\phi)*\left[\frac{L}{L-1}-1\right]*x_1+Q*\frac{x_1}{L-1} \quad (57)$$

$$(x_1 \leqq L-1)$$

$$M_1'=PLI*\sin(\phi)*x_1'+Q$$

$$(x_1' \leqq 1)$$

For the backup blade:

$$M=PLI*\sin(\phi)*\cos(\alpha)\left(\frac{L}{L-1}\right)*\left[\frac{s}{m}-1\right]*x+\frac{Q}{L-1}*\cos*(\alpha)*\left[\frac{s}{m}-1\right]*x \quad (x \leqq m) \quad (58)$$

$$M'=PLI*\sin(\phi)*\cos(\alpha)*\left(\frac{L}{L-1}\right)*x'+\left(\frac{Q}{L-1}\right)*\cos(\alpha)*x' \quad (x' \leqq s-m) \quad (59)$$

By Castigliano's Theorem, the slope at any point is given by $$\theta_A=\frac{\partial U}{\partial M_A} \quad (60)$$

where:

$\theta_A$ is the slope at point A

U is the strain energy of the entire system $M_A$ is the couple at point A. (This may be a dummy couple if no couple exists at this point).

The system strain energy is given by $$U=\int_0^L \frac{M^2}{2*E*I}*dx \quad (61)$$

where:

L is the beam length, inches

M is the moment equation over the beam length, inch*lbs

E is the beam's elastic modulus, psi

I is the beam's second area moment, $in^4$

The strain energy of our doctor and backup blade system is composed of four parts:

$$U_{Total}=U_{D1}+U_{D2}+U_{B1}+U_{B2}$$

where:

$U_{D1}$ is the strain energy of doctor blade Section #1

$U_{D2}$ is the strain energy of doctor blade Section #2

$U_{B1}$ is the strain energy of backup blade Section #1

$U_{B2}$ is the strain energy of backup blade Section #2

Using the subscripts "D" for the doctor blade and "B" for the backup blade, the system strain energy expands as follows:

$$U_{D1}=\int_0^{L-1}\frac{M_1^2}{2*E_D*I_D}*dx=\int_0^{L-1}\frac{\left[PLI*\sin(\phi)*\cos(\alpha)*\left[\frac{L}{L-1}-1\right]+Q*\frac{\cos(\alpha)}{L-1}\right]2}{2*E_D*I_D}x^2dx \quad (62)$$

-continued $$U_{D2}=\int_0^1 \frac{M_1^2}{2*E_D*I_D}\,dx=\int_0^1 \frac{(PLI*\sin(\phi)*x+Q)^2}{2*E_D*I_D}\,dx \tag{63}$$

$$U_{B1}=\int_0^m \frac{M^2}{2*E_B*I_B}\,dx=\int_0^m \frac{\left(PLI*\sin(\phi)*\cos(\alpha)*\left(\frac{L}{L-1}\right)*\left[\frac{s}{m}-1\right]+Q*\frac{\cos(\alpha)}{L-1}*\left[\frac{s}{m}-1\right]\right)^2}{2*E_B*I_B}\,x^2dx \tag{64}$$

$$U_{B2}=\int_0^{s-m} \frac{M^2}{2*E_B*I_B}\,dx=\int_0^{s-m} \frac{\left(PLI*\sin(\phi)*\cos(\alpha)*\left(\frac{L}{L-1}\right)+\left(\frac{Q}{L-1}\right)*\cos(\alpha)\right)^2}{2*E_B*I_B}\,x^2dx \tag{65}$$

Since the slope at the doctor blade tip is given by $$\theta_{Tip}=\frac{\partial U_{Total}}{\partial Q} \tag{66}$$

Q=Dummy couple at blade tip the individual strain energy equations, when differentiated with respect to the dummy couple, Q, and integrated over the corresponding section, are as follows:

For the first section of the doctor blade:

$$\frac{\partial U_{D1}}{\partial Q}=\int_0^{L-1} \frac{2*M_1}{2*E_D*I_D}*\left(\frac{\partial M_1}{\partial Q}\right)dx=\int_0^{L-1} \frac{\left[PLI*\sin(\phi)*\cos(\alpha)*\left[\frac{L}{L-1}-1\right]+Q*\frac{\cos(\alpha)}{L-1}\right]*x*\left(\frac{\cos(\alpha)*x}{L-1}\right)}{E_D*I_D}\,dx \tag{67}$$

$$\frac{\partial U_{D1}}{\partial Q}=\int_0^{L-1} \frac{\left[PLI*\sin(\phi)*\left[\frac{L}{L-1}-1\right]+\frac{Q}{L-1}\right]}{E_D*I_D*(L-1)}\cos^2(\alpha)*x^2dx \tag{68}$$

$$\frac{\partial U_{D1}}{\partial Q}=\frac{\left[PLI*\sin(\phi)*\left[\frac{L}{L-1}-1\right]+\frac{Q}{L-1}\right]}{3*E_D*I_D*(L-1)}\cos^2(\alpha)*(L-1)^3 \tag{69}$$

Since the dummy load, Q, equals zero, this equation simplifies to $$\frac{\partial U_{D1}}{\partial Q}=\frac{PLI*\sin(\phi)*\left(\frac{L}{L-1}-1\right)}{3*E_D*I_D}\cos^2(\alpha)*(L-1)^2 \tag{70}$$

For the second section of the doctor blade:

$$\frac{\partial U_{D2}}{\partial Q}=\int_0^1 \frac{2*M_1'}{2*E_D*I_D}*\left(\frac{\partial M_1'}{\partial Q}\right)dx=\int_0^1 \frac{2*(PLI*\sin(\phi)*x+Q)*x*(1)}{2*E_D*I_D}\,dx \tag{71}$$

-continued $$\frac{\partial U_{D2}}{\partial Q}=\frac{PLI*\sin(\phi)}{3*E_D*I_D}*1^2 \tag{72}$$

For the first section of the backup blade:

$$\frac{\partial U_{B1}}{\partial Q}=\int_0^m \frac{2*M}{2*E_B*I_B}*\left(\frac{\partial M}{\partial Q}\right)dx=\int_0^m \frac{\left[PLI*\sin(\phi)*\cos(\alpha)*\left[\frac{L}{L-1}-1\right]*\left(\frac{s}{m}-1\right)+\frac{Q}{L-1}*\cos(\alpha)*\left(\frac{s}{m}-1\right)\right]*x*\cos(\alpha)*\left(\frac{s}{m}-1\right)*x}{E_B*I_B*(L-1)}\,dx \tag{73}$$

$$\frac{\partial U_{B1}}{\partial Q}=\int_0^m \frac{\left[PLI*\sin(\phi)*\left[\frac{L}{L-1}\right]*\cos^2(\alpha)*\left(\frac{s}{m}-1\right)^2\right]}{E_B*I_B*(L-1)}\,x^2dx \tag{74}$$

$$\frac{\partial U_{B1}}{\partial Q}=\frac{PLI*\sin(\phi)*\left[\frac{L}{L-1}\right]*\cos^2(\alpha)*\left(\frac{s}{m}-1\right)^2}{3*E_B*I_B*(L-1)}\,m^3 \tag{75}$$

For the second section of the backup blade:

$$\frac{\partial U_{B2}}{\partial Q} = \int_0^{s-m} \frac{PLI*\sin(\phi)*\frac{L}{L-1}*\cos^2(\alpha)*x^2}{E_B*I_B*(L-1)}\,dx \tag{76}$$

$$\frac{\partial U_{B2}}{\partial Q} \quad \frac{PLI*\sin(\phi)*L*\cos^2(\alpha)}{3*E_B*I_B*(L-1)^2}(s-m)^3 \tag{77}$$

Summing all the components of the slope equation $$\partial_{Tip} = \frac{\partial U_{Total}}{\partial Q} = \frac{\partial U_{D1}}{\partial Q} + \frac{\partial U_{D2}}{\partial Q} + \frac{\partial U_{B1}}{\partial Q} + \frac{\partial U_{B2}}{\partial Q} \tag{78}$$

and substituting the appropriate equations $$\Theta_{Tip} = \frac{PLI*\sin(\phi)*\left(\frac{L}{L-1}-1\right)}{3*E_D*I_D}\cos^2(\alpha)*(L-1)^2 + \frac{PLI*\sin(\phi)}{3*E_D*I_D}*1^2 + \frac{PLI*\sin(\phi)*\left[\frac{L}{L-1}\right]*\cos^2(\alpha)*\left(\frac{s}{m}-1\right)^2}{3*E_B*I_B*(L-1)}m^3 + \frac{PLI*\sin(\phi)*L*\cos^2(\alpha)}{3*E_B*I_B*(L-1)^2}(s-m)^3 \tag{79}$$

Simplifying the above equation yields the blade slope at point of application of the dummy couple Q, which is at the doctor blade tip $$\theta_{Tip} = \frac{PLI*\sin(\phi)}{3*E_D*I_D}*\left[\left(\frac{L}{L-1}-1\right)*\cos^2(\alpha)*(L-1)^2+\frac{3}{2}*1^2\right] + \frac{PLI*\sin(\phi)}{3*E_B*I_B}*\left[\frac{L}{(L-1)^2}*\cos^2(\alpha)*(s-m)^2*m^3 + \frac{L}{(L-1)^2}*\cos^2(\alpha)*(s-m)^3\right] \tag{80}$$

An examination of this last equation shows how general its application is. It accounts for variations in blade lengths, thicknesses (via second area moment, I), and materials (via elastic modulus, E). Also accounted for are holder-imposed variations such as differing angles between the blades and different positions of the blades relative to one another. Tests designed to accurately measure doctor blade slope and deflection have verified this equation's accuracy.

The aforementioned terms have the following definitions:

PLI=Force applied to the doctor blade tip by the contacting cylinder. It is generally expressed as lbs per lineal inch of contact.

L=Width of doctor blade.

l=Doctor blade stickout. The length of doctor blade "sticking out" from the backup blade support.

α=The angle the doctor blade and backup blade make with one another.

ϕ=The angle the PLI load makes with the undeflected doctor blade.

s=Width of backup blade.

m=Location of force applied by the top plate to the backup blade, measured relative to supported end of the backup blade.

$P_F$=Force applied by the top plate to the backup blade.

A=Point at which backup blade is supported by the blade holder structure.

B=Point at which the doctor blade is supported by the holder structure. From FIG. 8A, one can see that the doctor blade is actually supported by the blade carrier. For the purposes of this analysis, this support is assumed rigid and part of the holder structure.

$R_{Ax}$=Holder-to-backup blade reaction force component acting in the x-direction.

$R_{Ay}$=Holder-to-backup blade reaction force component acting in the y-direction.

$R_{Bx}$=Holder-to-doctor blade reaction force component acting in the x-direction.

$R_{By}$=Holder-to-doctor blade reaction force component acting in the y-direction.

P=Force imposed on doctor blade by backup blade.

P'=Force imposed on backup blade by doctor blade.

$x_1$=Position, along the first section of the doctor blade, of internal moment and shear forces.

$V_1$=Internal shear force inside the first section of the doctor blade.

$M_1$=Internal moment inside the first section of the doctor blade.

$x_1'$=Position, along the second section of the doctor blade, of internal moment and shear forces.

$V_1'$=Internal shear force inside the second section of the doctor blade.

$M_1'$=Internal moment inside the second section of the doctor blade.

x=Position, along the first section of backup blade, of internal moment and shear forces.

V=Internal shear force inside the first section of backup blade.

M=Internal moment inside the first section of backup blade.

x'=Position, along the second section of backup blade, of internal moment and shear forces.

V'=Internal shear force inside the second section of backup blade.

M'=Internal moment inside the second section of backup blade.

The strain energy method used to determine the doctor blade deflection, normal to its surface, due to a load imposed at its tip will be hereinafter described. The procedure then for determining the deflection of an elastic structure (the doctor blade and backup blade system) at a particular point is:

1. Find the moment equation for the structure;
2. Compose the strain energy equation of the structure using the above equations;
3. Differentiate the strain energy equation with respect to the load imposed at the point in question (i.e. the doctor blade tip);
4. Integrate the resulting equation, with respect to x, over the structure's length.

This procedure differentiates before integrating to simplify the process, making use of the following:

$$y_T = \frac{\partial U}{\partial P_T} = \int_0^L \frac{\partial\left(\frac{M_T^2}{2EI}\right)}{\partial P_T}\,dx \tag{81}$$

The above procedure is applied to the "elastic structure" of the doctor blade and backup blade system supported by a blade holder as shown in FIG. 8A.

Figure 18:
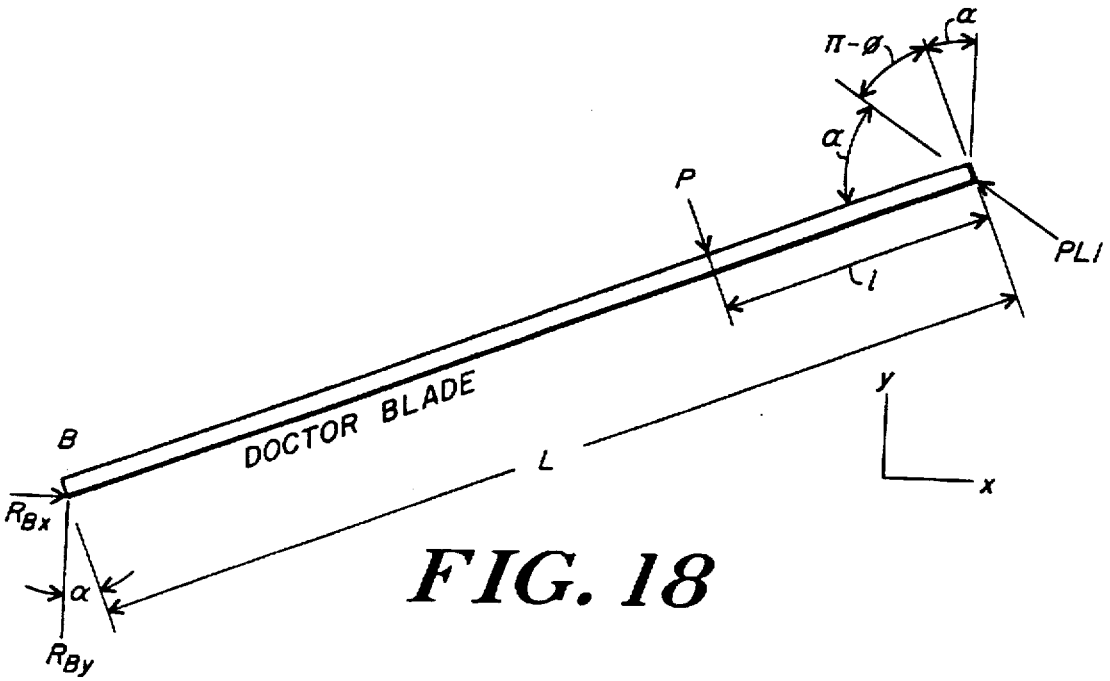

Initially, the reaction forces for each blade must be determined. With reference to the doctor blade shown in FIG. 18, the static equilibrium requires moments about point B sum to zero:

$$\Sigma M_B = 0$$

$$-(PLI*\sin\phi)*L+P*(L-1)=0$$

Solving for P $$P=\frac{PLI*\sin(\phi)*L}{(L-1)} \tag{82}$$

Static equilibrium requires forces acting in x-direction sum to zero:

$$\Sigma F_x=0$$

$$R_{Bx}-PLI*\cos(\phi-\alpha)+P*\sin(\alpha)=0$$

Solving for $R_{Bx}$ and substituting for P $$R_{Bx}=PLI*\cos(\phi-\alpha)-P*\sin(\alpha) \tag{83}$$

$$R_{Bx}=PLI*\left[\cos(\phi-\alpha)-\sin\phi*\sin\alpha*\left(\frac{L}{L-1}\right)\right]$$

Static equilibrium requires forces acting in y-direction sum to zero:

$$\Sigma F_y=0$$

$$R_{By}-P*\cos(\alpha)+PLI*\sin(\phi-\alpha)=0$$

Solving for $R_{By}$ and substituting for P $$R_{By}=P*\cos(\alpha)-PLI*\sin(\phi-\alpha) \tag{84}$$

$$R_{By}=PLI*\left[\sin\phi*\cos\alpha*\frac{L}{(L-1)}-\sin(\phi-\alpha)\right]$$

Summarizing, the forces acting on the doctor blade are:

$$P=\frac{PLI*\sin\phi*L}{(L-1)} \tag{85}$$

$$R_{Bx}=PLI*\left[\cos(\phi-\alpha)-\sin\phi*\sin\alpha*\left(\frac{L}{L-1}\right)\right] \tag{86}$$

$$R_{By}=PLI*\left[\sin\phi*\cos\alpha*\frac{L}{(L-1)}-\sin(\phi-\alpha)\right] \tag{87}$$

With reference to the backup blade shown in FIG. 15, the static equilibrium requires moments about point A sum to zero:

$$\Sigma M_A=0$$

$$P_F*m-P'*\cos(\alpha)*s=0$$

Solving for $P_F$ $$P_F=\frac{P'*\cos(\alpha)*s}{m} \tag{88}$$

Since, by examination, $|P'|=|P|$, substituting P from the doctor blade analysis for P' gives $$P_F=PLI*\sin(\phi)*\cos(\alpha)*\left(\frac{L}{L-1}\right)*\frac{s}{m} \tag{89}$$

Static equilibrium requires forces acting in x-direction sum to zero:

$$\Sigma F_x=0$$

$$R_{Ax}-P'*\sin(\alpha)=0$$

Solving for $R_{Ax}$ and substituting for P', $$R_{Ax}=PLI*\sin(\phi)*\sin(\alpha)*\left(\frac{L}{L-1}\right) \tag{90}$$

Static equilibrium requires forces acting in y-direction sum to zero:

$$\Sigma F_y=0$$

$$R_{Ay}-P_F+P'*\cos(\alpha)=0$$

Solving for $R_{Ay}$ $$R_{Ay}=P_F-P'*\cos(\alpha)$$

Substituting for P and P' gives:

$$R_{Ay}=PLI*\sin\phi*\cos\alpha\frac{L}{L-1}*\left[\frac{s}{m}-1\right] \tag{91}$$

Summarizing, $$P_F=PLI*\sin\phi*\cos\alpha*\left(\frac{L}{L-1}\right)*\frac{s}{m} \tag{92}$$

$$R_{Ax}=PLI*\sin\phi*\sin\alpha*\left(\frac{L}{L-1}\right) \tag{93}$$

$$R_{Ay}=PLI*\sin\phi*\cos\alpha*\frac{L}{L-1}*\left[\frac{s}{m}-1\right] \tag{94}$$

Next, the moment equations for each section of each blade must be determined.

With reference to the first section of the doctor blade shown in FIG. 16A, the moment equation is:

$$R_{By}*\cos\alpha*x_1-R_{Bx}*\sin\alpha*x_1-M_1=0$$

$$M_1=[R_{By}*\cos\alpha-R_{Bx}*\sin\alpha]*x_1$$

Substituting for $R_{By}$ and $R_{Bx}$ gives the moment equation for the first section as $$M_1=PLI*x_1*\cos\alpha*\left(\sin\phi*\cos\alpha*\frac{L}{L-1}-\sin(\phi-\alpha)\right)-PLI*x_1*\sin\alpha*\left(\cos(\phi-\alpha)-\sin\phi*\sin\alpha*\frac{L}{L-1}\right) \tag{95}$$

Using the following trigonometric identities $$\sin(a+b)=\sin a*\cos b+\cos a*\sin b$$

$$\cos(a+b)=\cos a*\cos b-\sin a*\sin b$$

and applying them to the quantities $\sin(\phi-\alpha)$ and $\cos(\phi-\alpha)$ and using the identity $\cos^2\alpha+\sin^2\alpha=1$ the above relationship for $M_1$ becomes $$M_1=PLI*\sin\phi*x_1*\left(\frac{L}{L-1}-1\right) \tag{96}$$

Figure 16B:
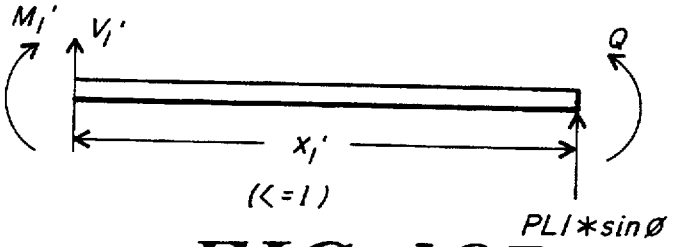

For the second section of the doctor blade as shown in FIG. 16B, the moment equation is found from $$M_1'-PLI*\sin\phi*x_1'=0$$

$$M_1'=PLI*\sin\phi*x_1 \qquad (x_1\leqq 1)$$

For the first section of the backup blade as shown in FIG. 17A, the moment equation is found from $$R_{Ay}*x-M=0$$

$$M=R_{Ay}*x$$

Substituting for $R_{Ay}$ gives $$M = PLI*\sin\phi*\cos\alpha*\left(\frac{L}{L-1}\right)*\left[\frac{s}{m}-1\right]*x \quad (97)$$

$$(x \leqq m)$$

For the second section of the backup blade as shown in FIG. 17B, the moment equation is $$M'-P'*\cos\alpha*x'=0$$

$$M'=P'*\cos\alpha*x'$$

Substituting for P'

$$M' = PLI*\sin\phi*\cos\alpha*\left(\frac{L}{L-1}\right)*x' \quad (98)$$

$$(x \leqq s-m)$$

Summarizing, the four blade sections' moment equations are as follows:

For the doctor blade:

$$M_1 = PLI*\sin\phi*x_1*\left(\frac{L}{L-1}-1\right) \quad (99)$$

$$(x_1 \leqq L-1)$$

$$M_1' = PLI*\sin\phi*x_1'$$

$$(x_1' \leqq 1)$$

For the backup blade:

$$M = PLI*\sin\phi*\cos\alpha*\left(\frac{L}{L-1}\right)*\left[\frac{s}{m}-1\right]*x \quad (100)$$

$$(x \leqq m)$$

$$M' = PLI*\sin\phi*\cos\alpha*\left(\frac{L}{L-1}\right)*x' \quad (101)$$

$$(x' \leqq s-m)$$

By Castigliano's Theorem, the deflection at any point is given by $$y_A = \frac{\partial U}{\partial P_A} \quad (102)$$

where:

$y_A$ is the slope at point A

U is the strain energy of the entire system $P_A$ is the load at point A.

The system strain energy is given by $$U = \int_0^L \frac{M^2}{2*E*I}*dx \quad (103)$$

where:

L is the beam length, inches

M is the moment equation over the beam length, inch*lbs

E is the beam's elastic modulus, psi

I is the beam's second area moment, $in^4$

The strain energy of our doctor and backup blade system is composed of four parts:

$$U_{Total}=U_{D1}+U_{D2}+U_{B1}+U_{B2}$$

where:

$U_{D1}$ is the strain energy of doctor blade Section #1

$U_{D2}$ is the strain energy of doctor blade Section #2

$U_{B1}$ is the strain energy of backup blade Section #1

$U_{B2}$ is the strain energy of backup blade Section #2

Using the subscripts "D" for the doctor blade and "B" for the backup blade, the system strain energy expands as follows:

$$U_{D1} = \int_0^{L-1} \frac{M_1^2}{2*E_D*I_D}*dx = \int_0^{L-1} \frac{\left[PLI*\sin\phi*\left(\frac{L}{L-1}-1\right)\right]^2}{2*E_D*I_D} x^2dx \quad (104)$$

$$U_{D2} = \int_0^1 \frac{M_1'^2}{2*E_D*I_D}\,dx = \int_0^1 \frac{(PLI*\sin\phi)^2}{2*E_D*I_D} x^2dx \quad (105)$$

$$U_{B1} = \int_0^m \frac{M^2}{2*E_B*I_B}\,dx = \int_0^m \frac{\left[PLI*\sin\phi*\cos\alpha*\left(\frac{L}{L-1}\right)*\left(\frac{s}{m}-1\right)\right]^2}{2*E_B*I_B} x^2dx \quad (106)$$

$$U_{B2} \int_0^{s-m} \frac{M'^2}{2*E_B*I_B}\,dx = \int_0^{s-m} \frac{\left[PLI*\sin\phi*\cos\alpha*\left(\frac{L}{L-1}\right)\right]^2}{2*E_B*I_B} x^2dx \quad (107)$$

Since the deflection at the doctor blade tip is given by $$y_{Tip} = \frac{\partial U_{Total}}{\partial P_{Tip}} \quad (108)$$

the individual strain energy equations, when differentiated with respect to the load, $P_{Tip}$, and integrated over the corresponding section, are as follows:

For the first section of the doctor blade:

$$\frac{\partial U_{D1}}{\partial(PLI*\sin\phi)} = \int_0^{L-1} \frac{2*M_1}{2*E_D*I_D}*\left(\frac{\partial M_1}{\partial(PLI*\sin\phi)}\right)dx = \int_0^{L-1} \frac{PLI*\sin\phi*\left(\frac{L}{L-1}-1\right)^2}{E_D*I_D} x^2dx \quad (109)$$

$$\frac{\partial U_{D1}}{\partial(PLI*\sin\Theta)} = \frac{PLI*\sin\phi}{3*E_D*I_D}\left[\frac{L}{L-1}-1\right]^2*(L-1)^3 \quad (110)$$

For the second section of the doctor blade:

$$\frac{\partial U_{D2}}{\partial(PLI*\sin\phi)} = \int_0^1 \frac{2*M_1'}{2*E_D*I_D}*\left(\frac{\partial M_1'}{\partial(PLI*\sin\phi)}\right)dx = \int_0^1 \frac{PLI*\sin\phi}{E_D*I_D} x^2dx \quad (111)$$

$$\frac{\partial U_{D2}}{\partial(PLI*\sin\phi)} = \frac{PLI*\sin\phi}{3*E_D*I_D}\,1^3 \quad (112)$$

For the first section of the backup blade:

$$\frac{\partial U_{B1}}{\partial(PLI*\sin\phi)} = \int_0^m \frac{2*M}{2*E_B*I_B} * \left(\frac{\partial M}{\partial(PLI*\sin\phi)}\right) dx = \int_0^m \frac{\left[PLI*\sin\phi*\cos\alpha*\left(\frac{L}{L-1}\right)*\left(\frac{s}{m}-1\right)\right]*\left[\cos(\alpha)*\left(\frac{L}{L-1}\right)*\left(\frac{s}{m}-1\right)\right]}{E_B*I_B} x^2dx \tag{113}$$

$$\frac{\partial U_{B1}}{\partial(PLI*\sin\phi)} = \int_0^m \frac{PLI*\sin\phi*\left[\cos\alpha*\left(\frac{L}{L-1}\right)*\left(\frac{s}{m}-1\right)\right]^2}{E_B*I_B} x^2dx \tag{114}$$

$$\frac{\partial U_{B1}}{\partial(PLI*\sin\phi)} = \frac{PLI*\sin\phi}{3*E_B*I_B} * \left[\left(\frac{L}{L-1}\right)*\left(\frac{s}{m}-1\right)*\cos(\alpha)\right]^2 m^3 \tag{115}$$

For the second section of the backup blade:

$$\frac{\partial U_{B2}}{\partial(PLI*\sin\phi)} = \int_0^{s-m} \frac{2*M'}{2*E_B*I_B} * \left(\frac{\partial M'}{\partial(PLI*\sin\phi)}\right) dx = \int_0^{s-m} \frac{\left[PLI*\sin\phi*\left(\frac{L}{L-1}\right)*\cos\alpha\right]*\left[\left(\frac{L}{L-1}\right)*\cos\alpha\right]}{E_B*I_B} x^2dx \tag{116}$$

$$\frac{\partial U_{B2}}{\partial(PLI*\sin\phi)} = \int_0^{s-m} \frac{PLI*\sin\phi*\left[\left(\frac{L}{L-1}\right)*\cos(\alpha)\right]^2}{E_B*I_B} x^2dx \tag{117}$$

$$\frac{\partial U_{B2}}{\partial(PLI*\sin\phi)} = \frac{PLI*\sin\phi}{3*E_B*I_B} * \left[\left(\frac{L}{L-1}\right)*\cos(\alpha)\right]^2 *(s-m)^3 \tag{118}$$

Summing all the components of the slope equation $$y_{Tip} = \frac{\partial U_{Total}}{\partial(PLI*\sin\phi)} = \frac{\partial U_{D1}}{\partial(PLI*\sin\phi)} + \frac{\partial U_{D2}}{\partial(PLI*\sin\phi)} + \frac{\partial U_{B1}}{\partial(PLI*\sin\phi)} + \frac{\partial U_{B2}}{\partial(PLI*\sin\phi)} \tag{119}$$

and substituting the appropriate equations $$y_{Tip} = \frac{PLI*\sin\phi}{3*E_D*I_D} * \left[\left(\frac{L}{L-1}-1\right)^2 *\cos^2(\alpha)*(L-1)^3+1^3\right] + \frac{PLI*\sin\phi}{3*E_B*I_B} * \left[\left(\frac{L}{L-1}\right)^2 * \cos(\alpha)^2\left[\left(\frac{s}{m}-1\right)^2 *m^3+(s-m)^3\right]\right] \tag{120}$$

Next, the method of calculating $\phi_c$ is described. Considering the doctorback, blade-holder, and doctor blade in contact with a cylinder a four-bar linkage, the angle $\phi_c$ can be found if all four link lengths are known as well as the angle between any two links. The angle chosen to be measured is $\phi_1$, the angle between link $R_O$ and link $R_1$ as shown in the linkage diagram of FIG. 19. The particular relationship is as follows:

$$\phi_c = acos\left[\frac{R_D^2-R_2^2-R_3^2}{2*R_2*R_3}\right] \tag{121}$$

where:

$R_D$=Distance from cylinder centerline to holder pivot centerline, inches;

$R_2$=Distance from holder pivot centerline to blade-cylinder contact point, inches;

$R_3$=Cylinder radius, inches.

Figure 19:
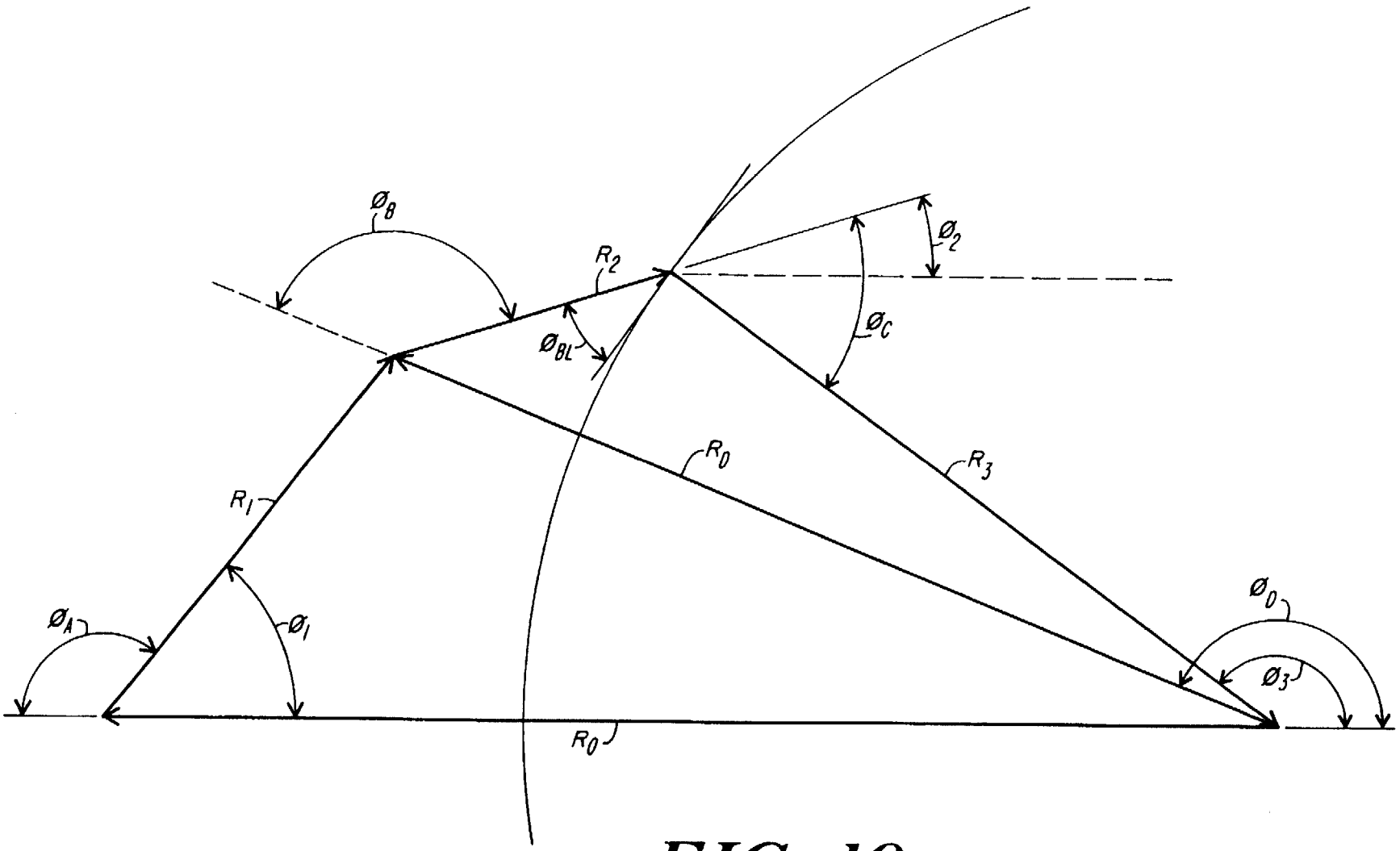
FIG. 19 shows a kinematically modeled four-bar linkage of the doctor apparatus for use in deriving the angle $\phi_c$.

Examining FIG. 19, the following vector statement can be made:

$$\vec{R}_D+\vec{R}_2+\vec{R}_3=0 \tag{122}$$

Solving for $\vec{R}_D$ $$-\vec{R}_D=\vec{R}_2+\vec{R}_3 \tag{123}$$

Taking the inner product (or dot product) of each side with itself and sing the definition of dot product $$(-\vec{R}_D)\cdot(-\vec{R}_D)=(\vec{R}_2+\vec{R}_3)\cdot(\vec{R}_2+\vec{R}_3) \tag{124}$$

$$R_D^2=R_2^2+2*R_2*R_3*\cos(\phi_c)+R_3^2$$

Solving for $\phi_c$ $$\phi_c = acos\left[\frac{R_D^2-R_2^2-R_3^2}{2*R_2*R_3}\right] \tag{125}$$

$R_D$ may be found from the following vector relationship, again referring to FIG. 19:

$$\vec{R}_D=\vec{R}_0+\vec{R}_1 \tag{126}$$

Using the same procedure as above yields the following:

$$R_D^2=R_0^2+2*R_0*R_1*\cos(\phi_A)+R_1^2$$

$\phi_A$ and $\phi_1$ are supplementary angles and as such are related as follows $$\phi_1 = \frac{\pi}{2} - \phi_A \tag{127}$$

$$\cos(\phi_1) = -\cos(\phi_A)$$

Substituting this latter relationship into the equation for $R_D^2$ and solving for $R_D$ gives $$R_D = [R_0^2 - 2*R_0*R_1*\cos(\phi_1) + R_1^2]^{1/2} \tag{128}$$

Summarizing, $$\phi_c = a\cos\left[\frac{R_D^2 - R_2^2 - R_3^2}{2*R_2*R_3}\right] \tag{129}$$

$$R_D[R_0^2 - 2*R_0*R_1*\cos(\phi_1) + R_1^2]^{1/2} \tag{130}$$

where:

$R_D$=Distance from cylinder centerline to holder pivot centerline, inches;

$R_2$=Distance from Holder pivot centerline to blade-cylinder contact point, inches;

$R_3$=Cylinder radius, inches.

$R_0$ and $R_3$ are fixed quantities. $R_2$ depends primarily on doctor blade length and to a lesser extend on backup blade length, both of which are measurable. The angle $\phi_1$ can be measured using an absolute angle sensor. With $R_0$, $R_2$, $R_3$ and $\phi_1$ known or measured, $\phi_c$ is known.

A derivation of blade load (PLI) as a function of air cylinder loading force and the instantaneous geometry of the doctor system will be provided hereinafter. The variable referred to as blade load ($F_p$) is actually one-half the total blade load and not the distributed blade load, or PLI. An alternative and more accurate measurement of blade load would use torque sensors in each doctor journal to measure $M_L$, the moment applied by the air cylinders to the doctor. Installed between the doctorback and the doctor-journal bearings, this measurement would eliminate both air cylinder friction and journal bearing friction from the PLI calculation. The current arrangement using load cells at the base of each air cylinder eliminates air cylinder friction, but not bearing friction from the PLI calculation. In defense of air cylinder-based load cells, the argument has been made that all friction coefficients will be the much smaller dynamic rather than static type due to doctor oscillation and vibrations inherent to the creping process.

The following definitions will hold:

$F_W$=One half the total doctor weight.

$\alpha_{FW}$=Angle $F_W$ makes with the horizontal.

$L_W$=Lever arm presented to doctor weight vector.

$\alpha_{LW}$=Angle $L_W$ makes with the horizontal.

$F_B$=Resultant reaction force at journal bearing.

$\alpha_{FB}$=Angle $F_B$ makes with the horizontal.

$F_f$=Journal-to-bearing friction force.

$\alpha_{Ff}$=Angle $F_f$ makes with the horizontal.

$L_f$=Lever arm present to friction force (=journal radius).

$\alpha_{Lf}$=Angle $L_f$ makes with the horizontal.

$F_P$=One-half the total blade loading force. The force of the roll pushing on the blade.

$\alpha_{FP}$=Angle $F_P$ makes with the horizontal.

$L_P$=Lever arm presented to the blade loading force.

$\alpha_{LP}$=Angle $L_P$ makes with the horizontal.

$F_L$=Force exerted on doctor lever by air loading cylinder.

$\alpha_{FL}$=Angle $F_L$ makes with the horizontal.

$L_L$=Lever arm presented to the air loading cylinder.

$\alpha_{LL}$=Angle $L_L$ makes with the horizontal.

$M_W$=Doctor weight moment about doctor journal.

$M_f$=Friction force moment about doctor journal.

$M_P$=Blade loading moment about doctor journal.

$M_L$=Air loading cylinder moment about doctor journal.

$\phi_T$=Translation Angle; the angle $R_O$ makes with the horizontal.

Figure 20:
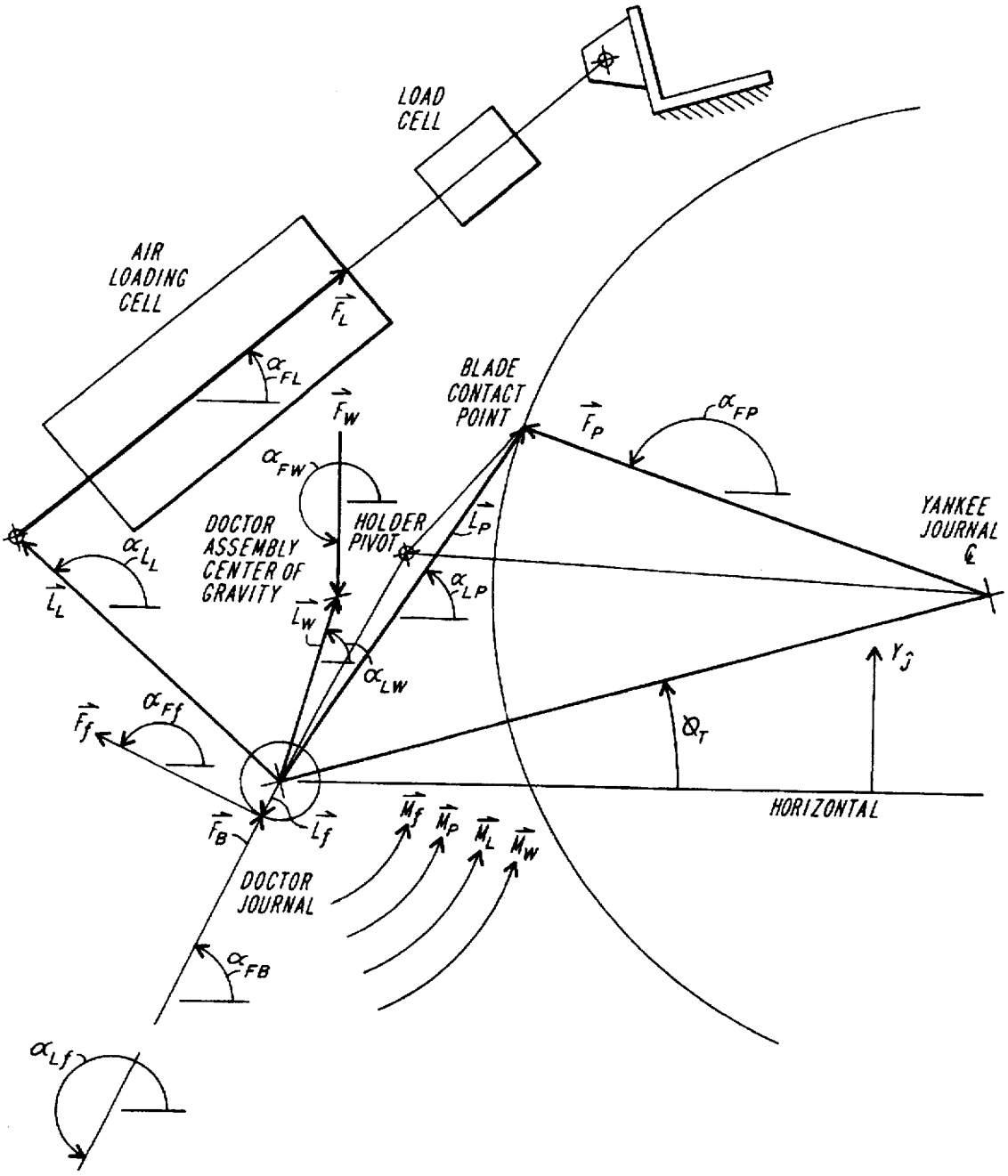
FIGS. 20, 21A, B, 22A, B, and 23 show vector models of the doctor apparatus used to derive blade load.

As static equilibrium, the sum of moments about the doctor journal center line as shown in FIG. 20 is:

$$\vec{M}_f + \vec{M}_P + \vec{M}_L + \vec{M}_W = 0 \tag{131}$$

The sum of x-direction forces=0 is:

$$F_B \cos\alpha_{FB} + F_f \cos\alpha_{Ff} + F_P \cos\alpha_{FP} + F_L \cos\alpha_{FL} = 0$$

The sum of y-direction forces=0 is:

$$F_W \sin\alpha_{FW} + F_B \sin\alpha_{FB} + F_f \sin\alpha_{Ff} + F_P \sin\alpha_{FP} + F_L \sin\alpha_{FL} = 0$$

Expanding the components of Equation 131, $$\begin{aligned} M_f = L_f \times F_f &= (L_f\cos\alpha_{Lf} i + L_f\sin\alpha_{Lf} j) \times (F_f\cos\alpha_{Ff} i + F_f\sin\alpha_{Ff} j) \\ &= L_f F_f \cos\alpha_{Lf}\cos\alpha_{Ff}(i \times i) + L_f F_f \cos\alpha_{Lf}\sin\alpha_{Ff}(i \times j) + \\ &\quad L_f F_f \sin\alpha_{Lf}\cos\alpha_{Ff}(j \times i) + L_f F_f \sin\alpha_{Lf}\sin\alpha_{Ff}(j \times j) \end{aligned} \tag{132}$$

Since $(\hat{i}\times\hat{i})=(\hat{j}\times\hat{j})=0$ and $\hat{i}\times\hat{j}=\hat{k}$ and $\hat{j}\times\hat{i}=-\hat{k}$, Equation 132 reduces to $$\vec{M}_f = L_f F_f(\cos\alpha_{Lf}\sin\alpha_{Ff} - \sin\alpha_{Lf}\cos\alpha_{Ff})\hat{k} \tag{133}$$

The remaining moments have the same form $$\vec{M}_P = L_P F_P(\cos\alpha_{LP}\sin\alpha_{FP} - \sin\alpha_{LP}\cos\alpha_{FP})\hat{k} \tag{134}$$

$$\vec{M}_L = L_L F_L(\cos\alpha_{LL}\sin\alpha_{FL} - \sin\alpha_{LL}\cos\alpha_{FL})\hat{k} \tag{135}$$

$$\vec{M}_W = L_W F_W(\cos\alpha_{LW}\sin\alpha_{FW} - \sin\alpha_{LW}\cos\alpha_{FW})\hat{k} \tag{136}$$

Substituting the above Equations back into Equation 131 and solving for $F_P$ (Blade Load) results in $$F_p = \frac{L_L F_L(\sin\alpha_{LL}\cos\alpha_{FL} - \cos\alpha_{LL}\sin\alpha_{FL}) + L_W F_W(\sin\alpha_{LW}\cos\alpha_{FW} - \cos\alpha_{LW}\sin\alpha_{FW}) + L_f F_f(\sin\alpha_{Lf}\cos\alpha_{Ff} - \cos\alpha_{Lf}\sin\alpha_{Ff})}{L_P(\cos\alpha_{LP}\sin\alpha_{FP} - \sin\alpha_{LP}\cos\alpha_{FP})} \tag{137}$$

For the frictionless case, the final term in the numerator is zero. The friction force is defined as $$\vec{F}_f = \mu_f\left[\frac{\vec{M}_{IMP}}{|\vec{M}_{IMP}|} \times \vec{F}_B\right] \quad \vec{M}_{IMP} = |\vec{M}_{IMP}|\hat{k} \tag{138}$$

where:

$\mu_f$=Static friction coefficient $\vec{F}_B$=Resultant bearing reaction force $\vec{M}_{IMP}$=Impending motion moment. This is the unbalanced moment that would exist if the friction force were momentarily reduced to zero. The direction of this moment determines the direction of the friction force.

Expanding Equation 138 results $$\vec{F}_f = \mu_f[F_B\cos\alpha_{FB}(\pm\hat{k}\times\hat{i}) + F_B\sin\alpha_{FB}(\pm\hat{k}\times\hat{j})] \tag{139}$$

$\hat{k}$ is positive for increasing blade load, negative for decreasing blade load. This direction could be determined by the loading air cylinder pressure switch.

Introducing the direction constant k, Equation 139 becomes $$\vec{F}_f=\mu_f K[F_B \sin \alpha_{FB}\hat{i}-F_B \cos \alpha_{FB}\hat{j}] \quad (140)$$

where:

$K$ = +1 for increasing blade load (clockwise)
= −1 for decreasing blade load (ccw)

The magnitude of $\vec{F}_f$ is $$F_f=\mu_f[(KF_B \sin \alpha_{FB})^2+(KF_B \cos \alpha_{FB})^2]^{1/2} \quad (141)$$

$$F_f=\mu_f F_B$$

The friction force angle is given by $$\alpha_{Ff}=\tan^{-1}\left[\frac{-F_B\cos\alpha_{FB}}{F_B\sin\alpha_{FB}}\right]+K_1\pi \quad (142)$$

where:

$K_1=0$ if $(-F_B \cos \alpha_{FB})>0$ and $(F_B \sin \alpha_{FB})>0$ or if $(-F_B \cos \alpha_{FB})<0$ and $(F_B \sin \alpha_{FB})>0$ $K_1=1$ if $(-F_B \cos \alpha_{FB})>0$ and $(F_B \sin \alpha_{FB})<0$ or if $(-F_B \cos \alpha_{FB})<0$ and $(F_B \sin \alpha_{FB})<0$ Substituting the appropriate friction component from Equation 140 and solving for $\alpha_{FB}$ & $F_B$ results $$F_B \cos \alpha_{FB}+\mu_f K F_B \sin \alpha_{FB}+F_P \cos \alpha_{FP}+F_L \cos \alpha_{FL}=0$$

$$F_W \sin \alpha_{FW}+F_B \sin \alpha_{FB}-\mu_f K F_B \cos \alpha_{FB}+F_P \sin \alpha_{FP}+F_L \sin \alpha_{FL}=0$$

Solving for $F_B$ gives $$F_{W\sin}\alpha_{FW}-\frac{(F_P\cos\alpha_{FP}+F_L\cos\alpha_{FL})}{\cos\alpha_{FB}+\mu_f K\sin\alpha_{FB})}(\sin\alpha_{FB}-\mu_f K\cos\alpha_{FB})+F_P\sin\alpha_{FB}+F_L\sin\alpha_{FL}=0 \quad (143)$$

Equation 143 cannot be solved explicitly for $\alpha_{FB}$. A root-finding technique such as the secant-search must be used. After finding $\alpha_{FB}$, $F_B$ is found as $$F_B=\frac{-(F_P\cos\alpha_{FP}+F_L\cos\alpha_{FL})}{(\cos\alpha_{FB}+\mu_f K\sin\alpha_{FB})} \quad (144)$$

The procedure to find $F_P$, the blade loading force, is as follows:

1) Start with $F_f=0$ & $\alpha_{Ff}=0$
2) Calculate $F_P$ from Equation 137
3) Substitute $F_P$ into Equation 143. Use a root-finder to find $\alpha_{FB}$.
4) Substitute $\alpha_{FB}$ into Equation 144. Solve for $F_B$.
5) Substitute $F_B$ into Equation 141. Solve for $F_f$.
6) Substitute $\alpha_{FB}$ & $F_B$ into Equation 142. Solve for $\alpha_{Ff}$.
7) Recalculate $F_P$ from Equation 137.
8) Repeat steps B–G until $F_P$ converges.

Several angles and lever arms need further definition:

$\alpha_{FW}$, $\alpha_{LW}$, $\alpha_{FP}$, $\alpha_{LP}$, $\alpha_{LL}$, $\alpha_{FL}$, $\alpha_{LA}$, $L_P$, $L_L$, $L_W$.

The angle $\alpha_{FW}$ will always be $$\frac{3\pi}{2},$$

since weight acts downward, thus $$\alpha_{FW}=\frac{3\pi}{2} \quad (145)$$

Figure 21A:
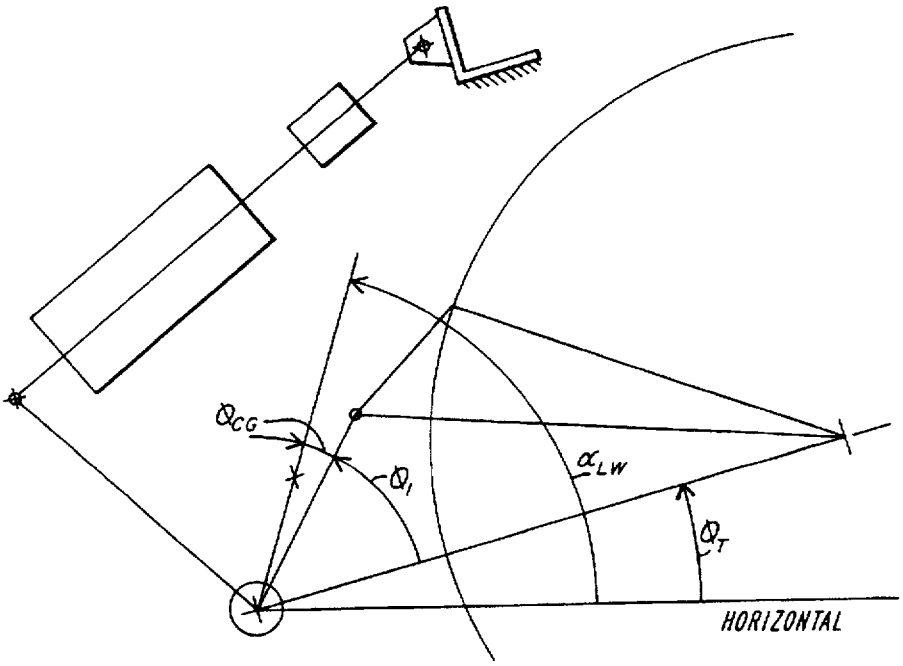

The angle $\alpha_{LW}$ is, by inspection of FIG. 21A, given by $$\alpha_{LW}=\phi_1+\alpha_{CG}+\phi_T \quad (146)$$

Figure 21B:
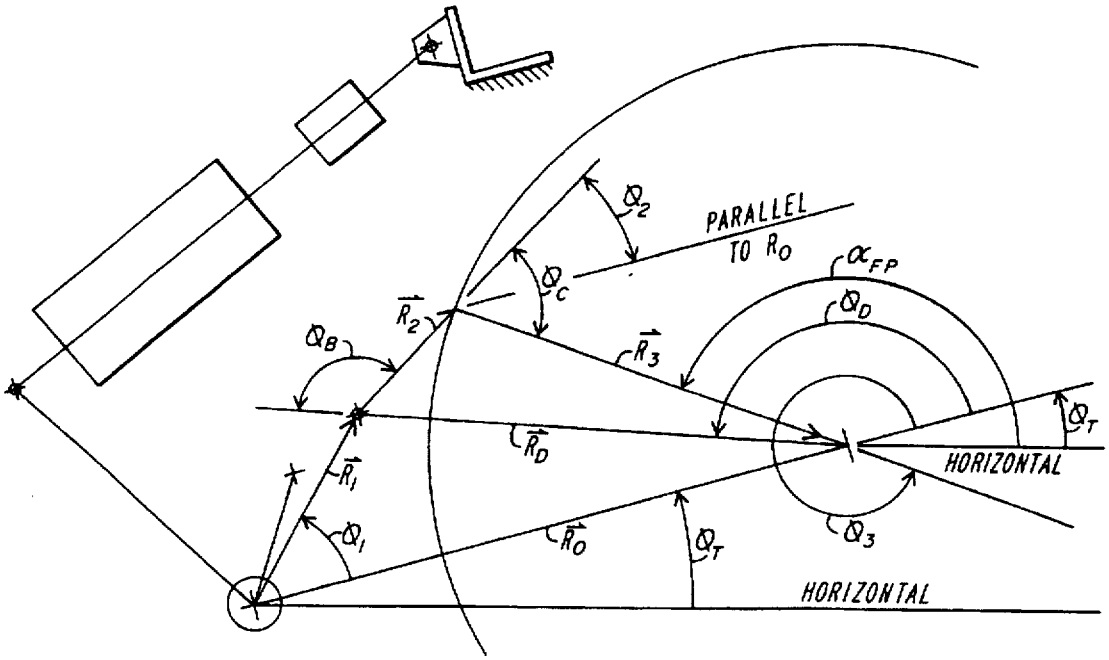

By inspecting FIG. 21B, $\alpha_{FP}$ can be found from $$\alpha_{FP}+\pi=\phi_3+\phi_T$$

$$\alpha_{FP}=\phi_3-\pi+\phi_T$$

$$\phi_3=2\pi-\phi_C-\phi_2=2\pi-\phi_C-(\phi_D-\phi_B)$$

$$\therefore \alpha_{FP}=\pi-\phi_C-\phi_D+\phi_B+\phi_T$$

$$\phi_c=A\cos\left[\frac{R_D^2-R_2^2-R_3^2}{2R_2R_3}\right] \quad (147)$$

$$\phi_D=A\cos\left[\frac{R_1^2-R_D^2-R_0^2}{2R_DR_0}\right] \quad (148)$$

$$\phi_B=A\cos\left[\frac{R_3^2-R_D^2-R_2^2}{2R_DR_2}\right] \quad (149)$$

$$R_D=[R_0^2-2R_0R_1\cos\phi_1+R_1^2]^{\frac{1}{2}} \quad (150)$$

Figure 22A:
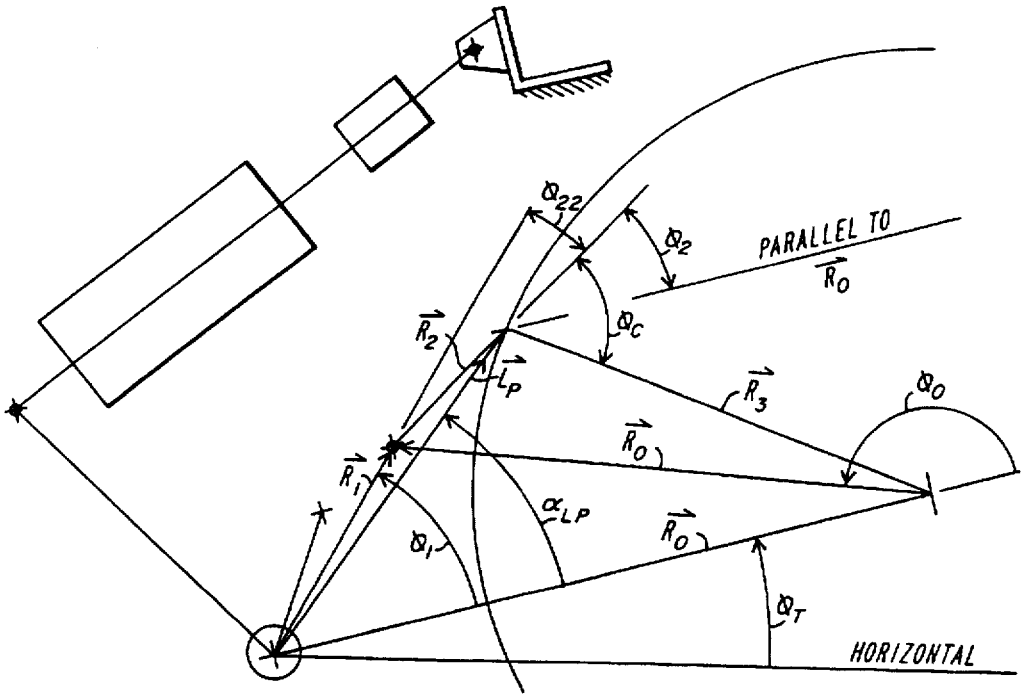

With reference to FIG. 22A, $\alpha_{LP}$ is derived by $$\vec{R}_0+\vec{L}_P+\vec{R}_3=0 \quad (151)$$

$$\vec{R}_0\vec{L}_P=-\vec{R}_3 \quad (152)$$

$$R_0^2-2R_0L_P \cos (\alpha_{LP}+\phi_T)+L_P^2=R_3^2 \quad (153)$$

$$\alpha_{LP}=A\cos\left[\frac{R_0^2+L_P^2-R_3^2}{2R_0L_P}\right]+\phi_T \quad (154)$$

Also, from the same diagram, $$\vec{R}_1+\vec{R}_2=\vec{L}_P \quad (155)$$

$$R_1^2+2R_1R_2 \cos \phi_{22}+R_2^2=L_P^2 \quad (156)$$

$$L_P=(R_1^2+2R_1R_2 \cos \phi_{22}+R_2^2)^{1/2} \quad (157)$$

$$\phi_{22}=\phi_1-\phi_2=\phi_1-(\phi_D-\phi_C)=\phi_1-A\cos\left[\frac{R_1^2-R_D^2-R_0^2}{2R_DR_0}\right]+A\cos\left[\frac{R_3^2-R_D^2-R_2^2}{2R_DR_2}\right] \quad (158)$$

$$R_D=(R_0^2-2R_0R_1 \cos \phi_1+R_1^2)^{1/2} \quad (159)$$

Substituting Equation 159 into Equation 158, Equation 158 into Equation 157, and Equation 157 into 154 gives a relationship for $\alpha_{LP}$ in terms of link lengths and the measured angle, $\phi_1$.

Figure 22B:
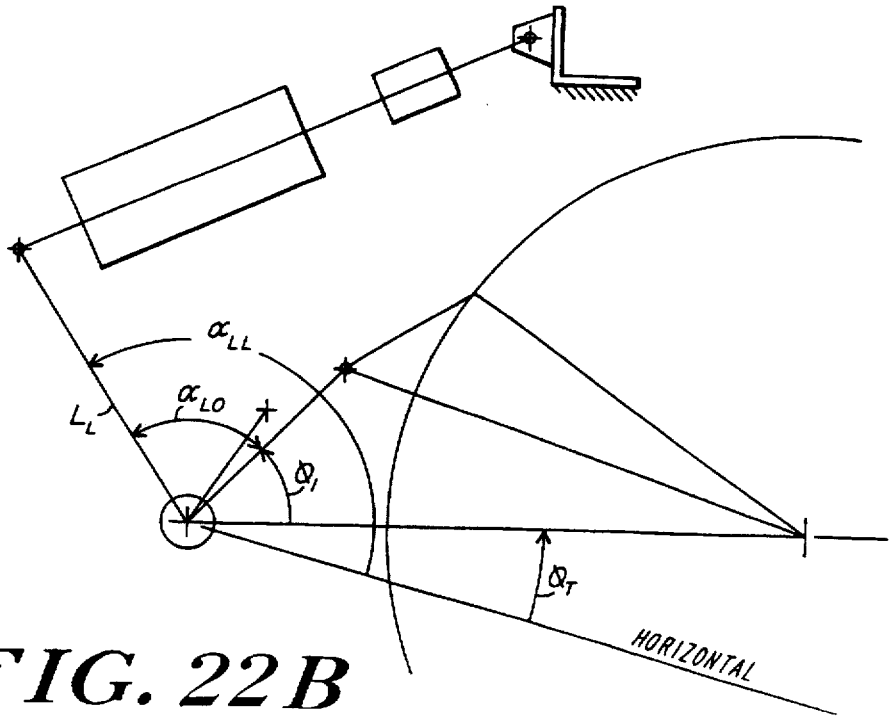

The angle $\alpha_{LL}$ is found upon inspection of FIG. 22B, thus $$\alpha_{LL}=\phi_1+\alpha_{LO}+\phi_T$$

$\alpha_{LO}$=Lever offset (established at design time)

Figure 23:
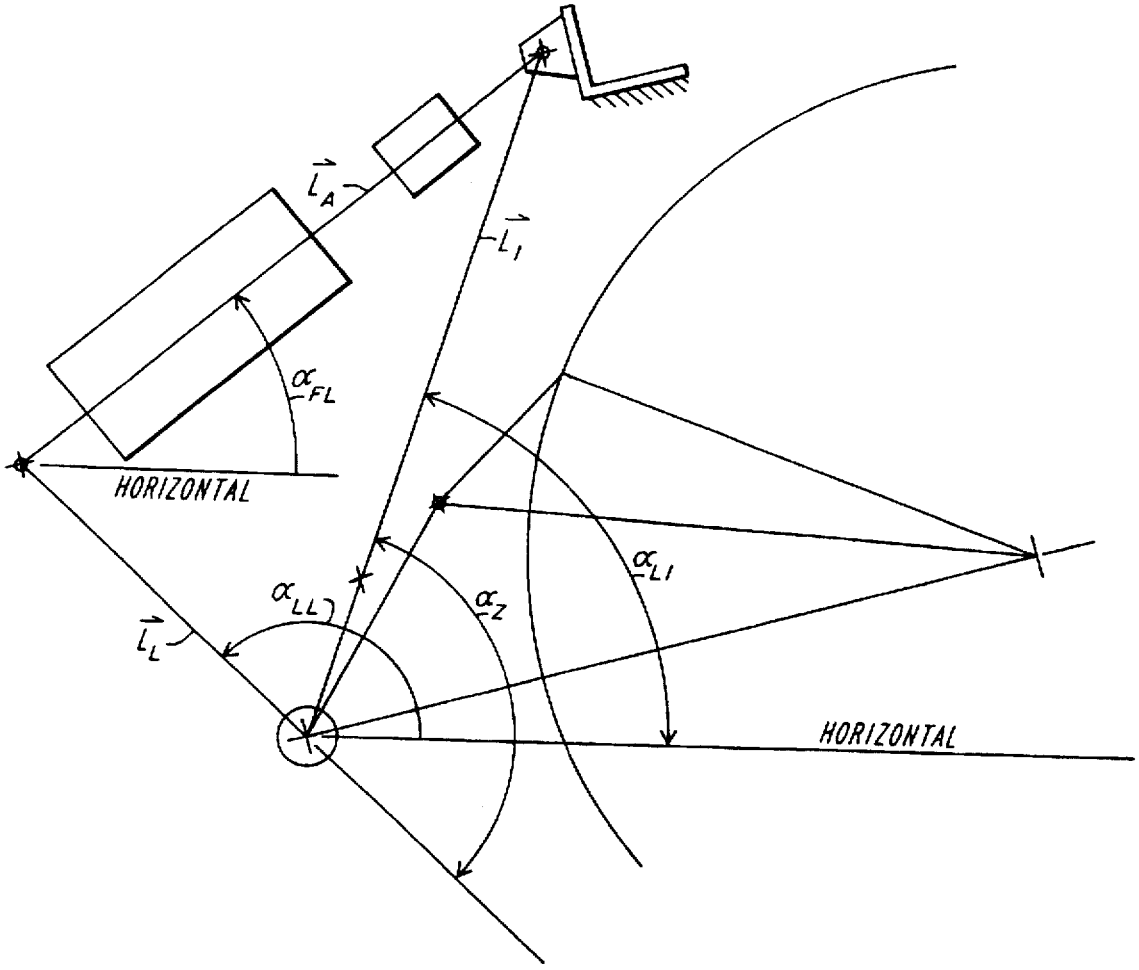

The angle $\alpha_{FL}$ is found upon inspection of FIG. 23, thus $$\alpha_{FL}=\alpha_{LL}-\alpha_{LA}$$

where $\alpha_{LA}$ is found $$\vec{L}_L+\vec{L}_A=\vec{L}_1 \quad (160)$$

$$L_L^2+2L_LL_A\cos\alpha_{LA}+L_A^2=L_1^2$$

$$\alpha_{LA}=A\cos\left[\frac{L_1^2-L_L^2-L_A^2}{2L_LL_A}\right] \quad (161)$$

and $L_A$ is $$\vec{L}_A=\vec{L}_1-\vec{L}_L \quad (162)$$

$$L_A^2=L_1^2+2L_1L_L\cos\alpha_2+L_L^2$$

$$\alpha_2=\pi-(\alpha_{LL}-\alpha_{L1})$$

$$\pi-\alpha_2=\alpha_{LL}-\alpha L1$$

$$\therefore L_A=(L_1^2-2L_1L_{L\ cos}(\alpha_{LL}-\alpha_{L1})+L_L^2)^{1/2} \quad (163)$$

where $\alpha_{L1}$ is a constant angle, measured at set-up.

Substituting Equation 163 into Equation 161, and that result into the equation for $\alpha_{FL}$ gives a relationship for $\alpha_{FL}$ in terms of fixed length members and the measured angle $\phi_1$.

In finding $\alpha_{Lf}$, $\vec{L}_f$ acts coincidently with $\vec{F}_B$, but in the opposite direction, so $$\alpha_{Lf}=\alpha_{FB}+\pi$$

The lever arm $L_P$ was given by the equation $$L_P=(R_1^2+2R_1R_2\cos\phi_{22}+R_2^2)^{1/2} \quad (164)$$

$$\phi_{22}=\phi_1-\phi_2=\phi_1-(\phi_D-\phi_C)= \quad (165)$$

$$\phi_1-A\cos\left[\frac{R_1^2-R_D^2-R_0^2}{2R_DR_0}\right]+A\cos\left[\frac{R_3^2-R_D^2-R_2^2}{2R_DR_2}\right]$$

$$R_D=(R_0^2-2R_0R_1\cos\phi_1+R_1^2)^{1/2} \quad (166)$$

$R_0$, $R_1$, $R_2$ are constants. $\phi_1$ is a measured angle.

$L_L$ is the length of the doctor lever arm, from doctor journal center line to the lever-air cylinder pivot center line. This is measured at set up. $L_W$ is the doctor weight lever arm, and is the distance from doctor journal center line to the doctor center of gravity. This distance is also determined at set-up.

The foregoing description has been set forth to illustrate the invention and is not intended to be limiting. Since modifications of the described embodiments incorporating the spirit and substance of the invention may occur to persons skilled in the art, the scope of the invention should be limited solely with reference to the appended claims and equivalents thereof.

What is claimed is:

1. A method of controlling, with a processor unit having associated sensors, doctor blade loading force in real-time of an arrangement including a doctor apparatus operating in connection with a rotating cylinder, said apparatus having a doctor blade and a support member that pivots about at least one pivot point in response to an externally applied force, which is provided by a force application module, in order to apply said doctor blade to a contact point on said cylinder, said method comprising:

providing to said processor unit an operational value for said externally applied force;

measuring the angle between said doctor blade and the line tangent to said cylinder passing through said contact point with a first sensor and said processor unit;

measuring with a second sensor an actual value of said externally applied force and providing the measurement to said processor;

calculating with said processor unit said blade load as a mathematical function of the moment arm between said force application module and said at least one pivot point acting through said support member, the length between said contact point on said cylinder and said at least one pivot point, the measured angle between said doctor blade and said line tangent to said cylinder passing through said contact point, and the measured actual value of said externally applied forces;

determining the difference between said operational value and said measured actual value of said externally applied force; and adjusting said externally applied force provided by said force application module in order to minimize the difference between said operational value and said measured actual value of said externally applied force.

2. A method of controlling, with a processor unit having associated sensors, deflected doctor blade angle and loading force in real-time of an arrangement including a doctor apparatus operating in connection with a rotating cylinder, said apparatus having a doctor blade and a support member which pivots about at least one pivot point in response to an externally applied force for applying said doctor blade to a contact point on a said cylinder, said arrangement corresponding to a kinematic model of linkages including a first link having a first length defined between said at least one pivot point and said contact point, a second link having a second length defined between said contact point and the center of said cylinder, and a third link having a third length defined between the center of said cylinder and said at least one pivot point, said method comprising:

measuring the angle between a selected pair of said links with a first sensor and said processor unit;

determining with said processor unit the remaining angles between said links as a mathematical relationship between said measured angle and said lengths of each link;

determining with said processor unit an undeflected blade angle which corresponds to an angle between said doctor blade and a tangent line through said contact point on said cylinder, said undeflected blade angle being a mathematical function of the determined angle between said first and second links;

measuring with a second sensor said externally applied force and providing the measurement to said processor unit;

calculating with said processor unit said blade load as a mathematical function of the moment arm between said externally applied force and said at least one pivot point acting through said support member, the length between said contact point on said cylinder and said at least one pivot point, the measured angle between said doctor blade and said line tangent to said cylinder passing through said contact point, and the measured actual value of said externally applied force;

calculating with said processor unit said deflected blade angle as a mathematical function of said undeflected blade angle and said blade load;

determining the difference between said operational value and said measured actual value of said externally applied force; and adjusting said externally applied force provided by said force application module in order to minimize the difference between said operational value and said measured actual value of said externally applied force.

3. A method of controlling, with a processor unit having associated sensors, deflected doctor blade angle and loading force in real-time of an arrangement including a doctor apparatus operating in connection with a rotating cylinder, said apparatus having a support member which pivots about a first pivot point in response to an externally applied force and a doctor blade and a blade holder which pivots about a second pivot point in response to a said externally applied force, said apparatus operable for applying said doctor blade to a contact point on said cylinder in response to said externally applied force, said arrangement corresponding to a kinematic model of linkages including a first link having a first length defined between said first and second pivot points, a second link having a second length defined between said second pivot point and said contact point, a third link having a third length defined between said contact point and the center of said cylinder, and a fourth link having a fourth length defined between the center of said cylinder and said first pivot point, said method comprising:

measuring the angle between a selected pair of said links with a first sensor and said processor unit;

determining with said processor unit the remaining angles between said links as a mathematical relationship between said measured angle and said lengths of each link;

determining with said processor unit an undeflected blade angle which corresponds to an angle between said doctor blade and a tangent line through said contact point on said cylinder, said undeflected blade angle being a mathematical function of the determined angle between said first and second links;

measuring with a second sensor said externally applied force and providing the measurement to said processor unit;

calculating with said processor unit said blade load as a mathematical function of the moment arm between said externally applied force and said at least one pivot point acting through said support member, the length between said contact point on said cylinder and said at least one pivot point, the measured angle between said doctor blade and said line tangent to said cylinder passing through said contact point, and the measured actual value of said externally applied force;

calculating with said processor unit said deflected blade angle as a mathematical function of said undeflected blade angle and said blade loads determining the difference between said operational value and said measured actual value of said externally applied force; and adjusting said externally applied force provided by said force application module in order to minimize the difference between said operational value and said measured actual value of said externally applied force.

* * * * *